US005544870A

United States Patent [19]

Kelley et al.

[11] Patent Number: 5,544,870

[45] Date of Patent: Aug. 13, 1996

[54] PLAY ENCLOSURE APPARATUS

[75] Inventors: Miriam Kelley, Buffalo; Daniel M. Dignitti, Hamburg, both of N.Y.

[73] Assignee: Fisher-Price, Inc., East Aurora, N.Y.

[21] Appl. No.: 292,821

[22] Filed: Aug. 19, 1994

[51] Int. Cl.[6] ..... E04H 17/16; A63H 33/42

[52] U.S. Cl. ..... 256/26; 256/25; 446/478; 292/150; 292/300

[58] Field of Search ..... 256/24, 25, 26; 5/99.1, 98.1; 446/476, 478, 488, 487; 160/135, 233; 292/DIG. 65, 150, 300; 49/394, 50

[56] References Cited

U.S. PATENT DOCUMENTS

| | | | |
|---|---|---|---|
| D. 344,121 | 2/1994 | Warren | D21/240 |
| D. 348,988 | 7/1994 | Bro et al. | D6/331 |
| 1,315,628 | 9/1919 | Gilbert | 446/487 X |
| 1,343,065 | 6/1920 | Suyehiro | 446/478 |
| 1,647,733 | 11/1927 | Keichline | 446/478 X |
| 1,661,003 | 2/1928 | Miller | 160/135 X |
| 2,011,528 | 6/1934 | Seay | 256/26 |
| 2,717,064 | 9/1955 | Hock | 49/394 |
| 3,895,670 | 7/1975 | Bales et al. | 160/135 |
| 4,343,117 | 8/1982 | Shemitz | 52/90 |
| 4,536,162 | 8/1985 | Ace, Jr. et al. | 446/102 |
| 4,645,183 | 2/1987 | Rattray et al. | 256/25 |
| 5,025,517 | 6/1991 | Johnson | 5/98.1 X |
| 5,265,848 | 11/1993 | Michaud et al. | 256/26 |

FOREIGN PATENT DOCUMENTS

| | | | |
|---|---|---|---|
| 478808 | 11/1951 | Canada | 5/99.1 |
| 1135446 | 4/1957 | France | 446/478 |
| 310769 | 11/1955 | Switzerland . | |
| WO84/01497 | 4/1984 | WIPO | 256/25 |

OTHER PUBLICATIONS

Today's Kids Wish Book, 1994, "Play'N Fold Clubhouse", p. 3.

Today's Kids Wish Book, 1994, "Infant–Toddler Playland", p. 4.

Little Tikes: Toys That Last, 1994, "Activity Garden", p. 4.

Little Tikes: Toys That Last, 1994, "Log Cabin", p. 56.

Little Tikes; Toys That Last, 1994, "Castle", p. 56.

Little Tikes: Toys That Last, 1994, "Evergreen Playhouse", p. 57.

Little Tikes: Toys That Last, 1994, "Country Cottage", p. 59.

Step Two: A Step Beyond, 1994, "Drive–In Playhouse", p. 22.

Step Two: A Step Beyond, 1994, "Snap–Together Fence", p. 23.

Clairbois, Guide des Nouveautes 93, "Le Jardin Des Oursons".

*Primary Examiner*—Anthony Knight

*Attorney, Agent, or Firm*—Howrey & Simon; C. Scott Talbot; Leo J. Jennings

[57] ABSTRACT

A play enclosure apparatus includes a plurality of panels that are detachably connectable to each other at their sides to form a play enclosure. The panels may be connected to form enclosures of various shapes, and two of the panels may be connected to trap the remaining panels between the two panels for portability or storage.

14 Claims, 43 Drawing Sheets

PLAY ENCLOSURE APPARATUS

BACKGROUND OF THE INVENTION

The invention relates to a convertible play enclosure apparatus having a number of detachably inter-connectable panels. More specifically, the invention relates to an apparatus that is convertible between several configurations including a play yard enclosure configuration, a play house configuration, and a compact configuration for portability and storage. In addition, the invention relates to a connector system for detachably connecting the panels, and to a releasable lock mechanism for locking a door provided in one of the panels.

Portable and folding playpens for infants are known. However, these folding playpens usually have only one operative, unfolded size and shape of enclosure. Also, since they are generally intended to serve only as an enclosure to prevent the infant from escaping, they typically do not include a door or other child-usable exit.

An example of a folding play enclosure is shown in U.S. Pat. No. 5,265,848 to Michaud, et al., which describes a folding play enclosure for children including a plurality of flat panels connected in series in an accordion-fold manner by a plurality of folding joints. The panels are formed by cardboard sheets sandwiched between inner and outer flexible vinyl layers. The folding joints are formed by the provision of spaces between the ends of each adjacent pair of cardboard sheets.

This play enclosure design suffers from several disadvantages. For example, the positions of the panels relative to each other (that is, which panels are adjacent which other panels) is fixed and cannot be changed. Similarly, it is not possible to add extra panels or remove panels to change the enclosure by adding a new, different panel. Also, there is no provision for locking the angle of the folding joints—they are always free to pivot—and thus the overall structural integrity of the apparatus when unfolded is not as strong as would be achieved by lockable hinges. An additional disadvantage of the design shown in the Michaud, et al. patent is that no provision is made for a working lockable door.

SUMMARY OF THE INVENTION

The drawbacks of the prior art are overcome by the apparatus of the invention, which provides a play enclosure apparatus, having a number of selectively interconnectable panels, that is convertible between several configurations including, for example, a hexagonal play yard enclosure configuration, a rectangular play house configuration, and a compact configuration for portability and storage.

In one aspect, the invention relates to an enclosure apparatus having a plurality of panels, each panel having a first connector portion on one side and a second connector portion on the other side. Each of the first connector portions is releasably connectable with each of the second connector portions to connect any of the panels to another panel, and a mechanism is provided for selectively locking the connector portions to selectively fix the relative angle between two connected panels.

In another aspect, the invention relates to an enclosure apparatus having at least three connectable panels. At least one of the panels may be trapped between two other panels when the two other panels are connected to each other at both ends.

In still another aspect, the invention relates to a connector system for connecting a first panel to a second panel, including a first connector portion on the first panel having a first contact portion. A second connector portion on the same side of the first panel as the first connector portion is spaced apart from the first connector portion by a space defined between the first and second connector portions, and the second connector portion and has a second contact portion. A third connector portion on the second panel is shaped to fit between the first and second connector portions and has a third contact portion for contacting the first contact portion and a fourth contact portion for contacting said second contact portion. A releasable mechanism is provided for selectively urging the first and third contact portions into contact with each other and the second and fourth contact portions into contact with each other, respectively, to hold the third connector portion securely between the first and second connector portions, thereby connecting the first panel to the second panel.

In yet another aspect, the invention relates to a lock mechanism for selectively locking closed a door hingedly mounted in a doorway opening defined by one panel.

Figure 14D:
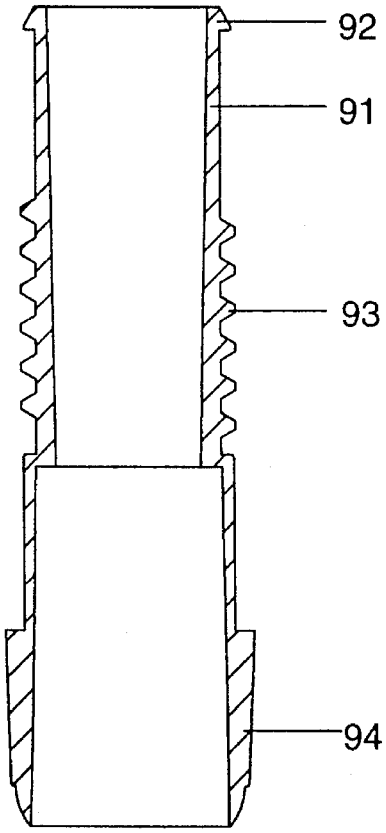
FIG. 14A, 14B and 14C are perspective, front, and bottom views, respectively, of the threaded knob.
Figure 14A:
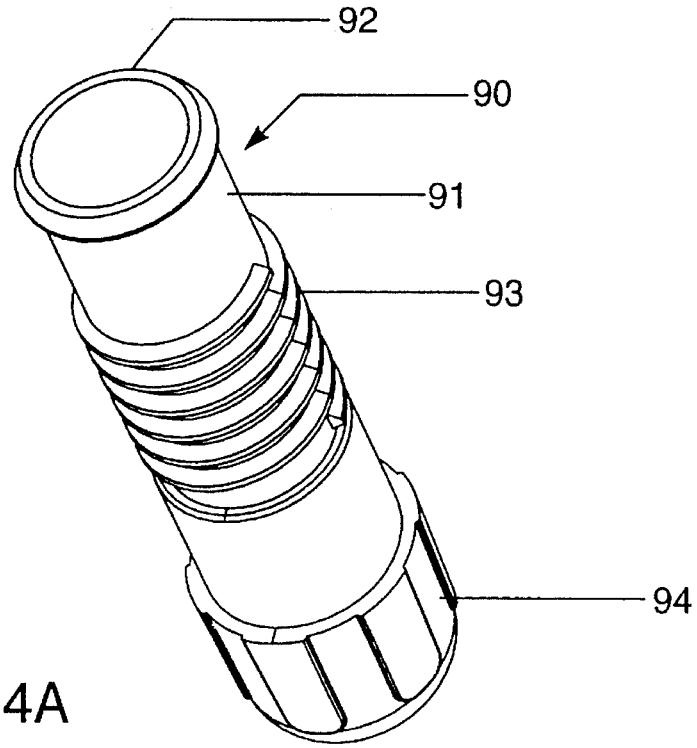
Figure 14B:
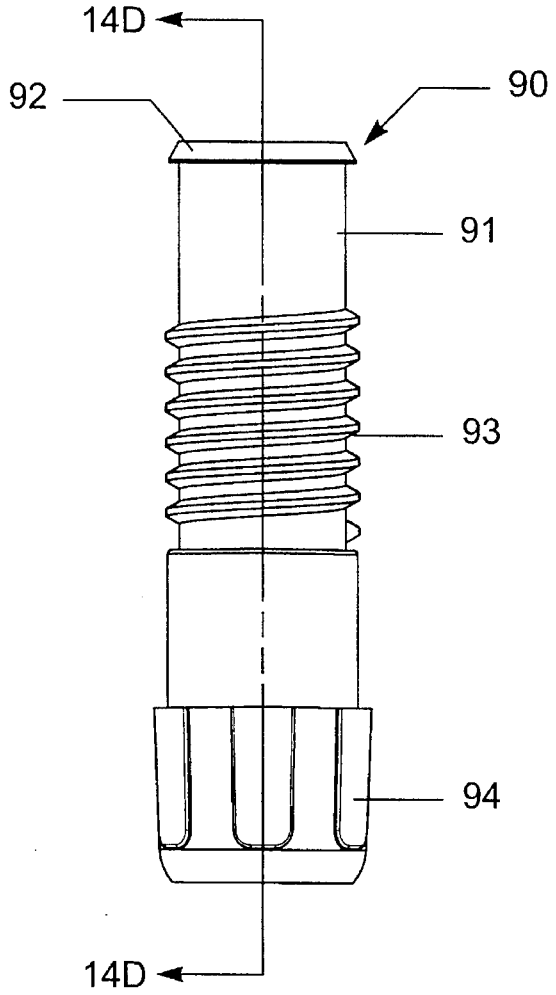
Figure 14C:
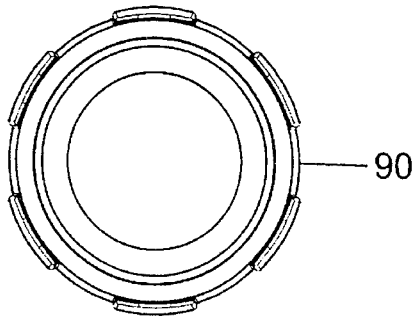

FIG: 14D is a cross-sectional view taken along line 14D in FIG. 14B.

DETAILED DESCRIPTION

Reference will now be made in detail to presently preferred embodiments of the invention, examples of which are illustrated in the accompanying drawings. The apparatus generally comprises a front house panel 20, a door 30, a locking bar 40, a rear house panel 50, four substantially identical fence panels. 60, a plurality of toothed locking caps 70, and a plurality of sleeves 80 and threaded connectors 90.

Figure 1A:
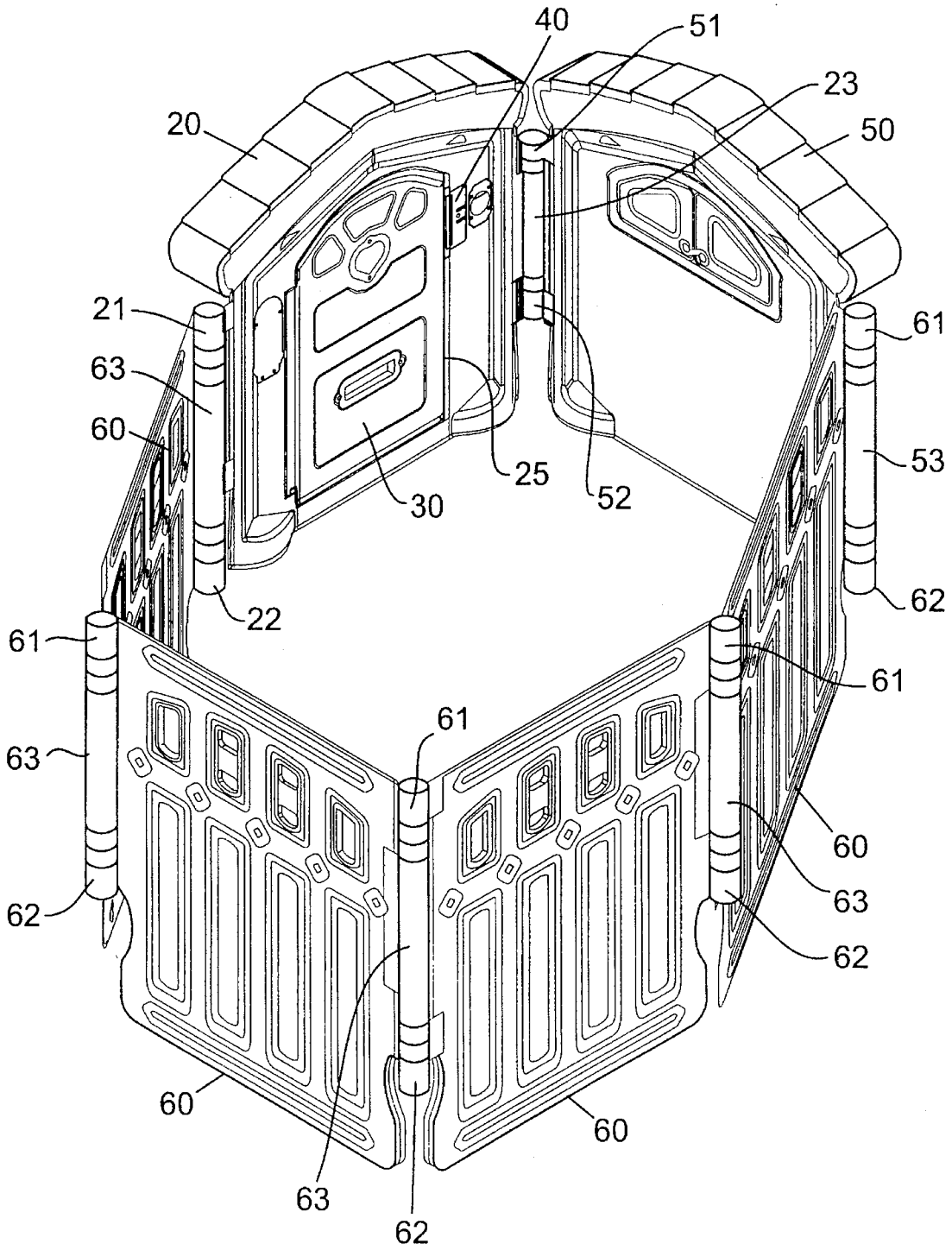
FIGS. 1A, 1B and 1C are perspective views showing the apparatus in the play yard mode, play house mode, and compact storage mode, respectively.
Figure 1B:
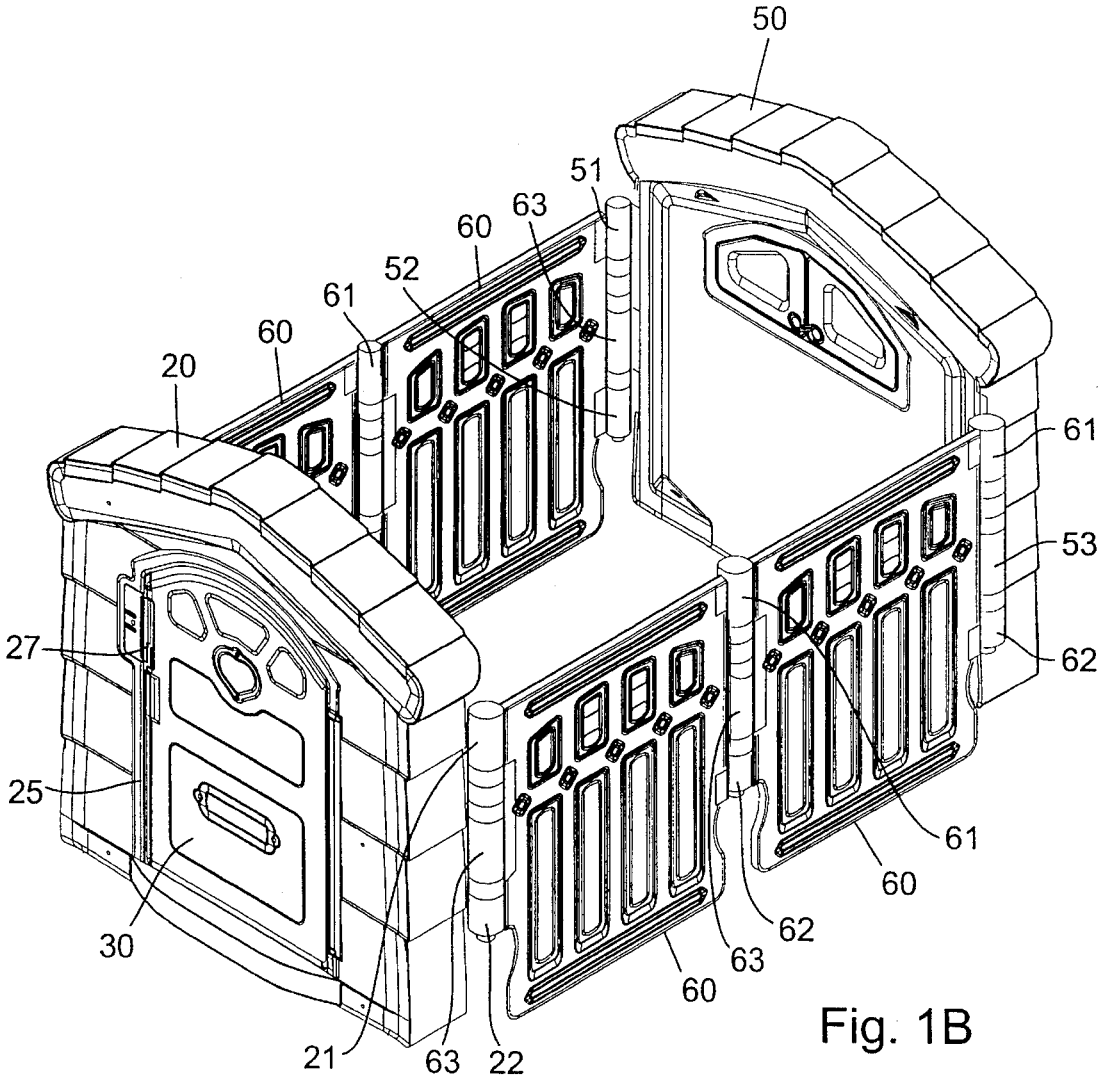
Figure 1C:
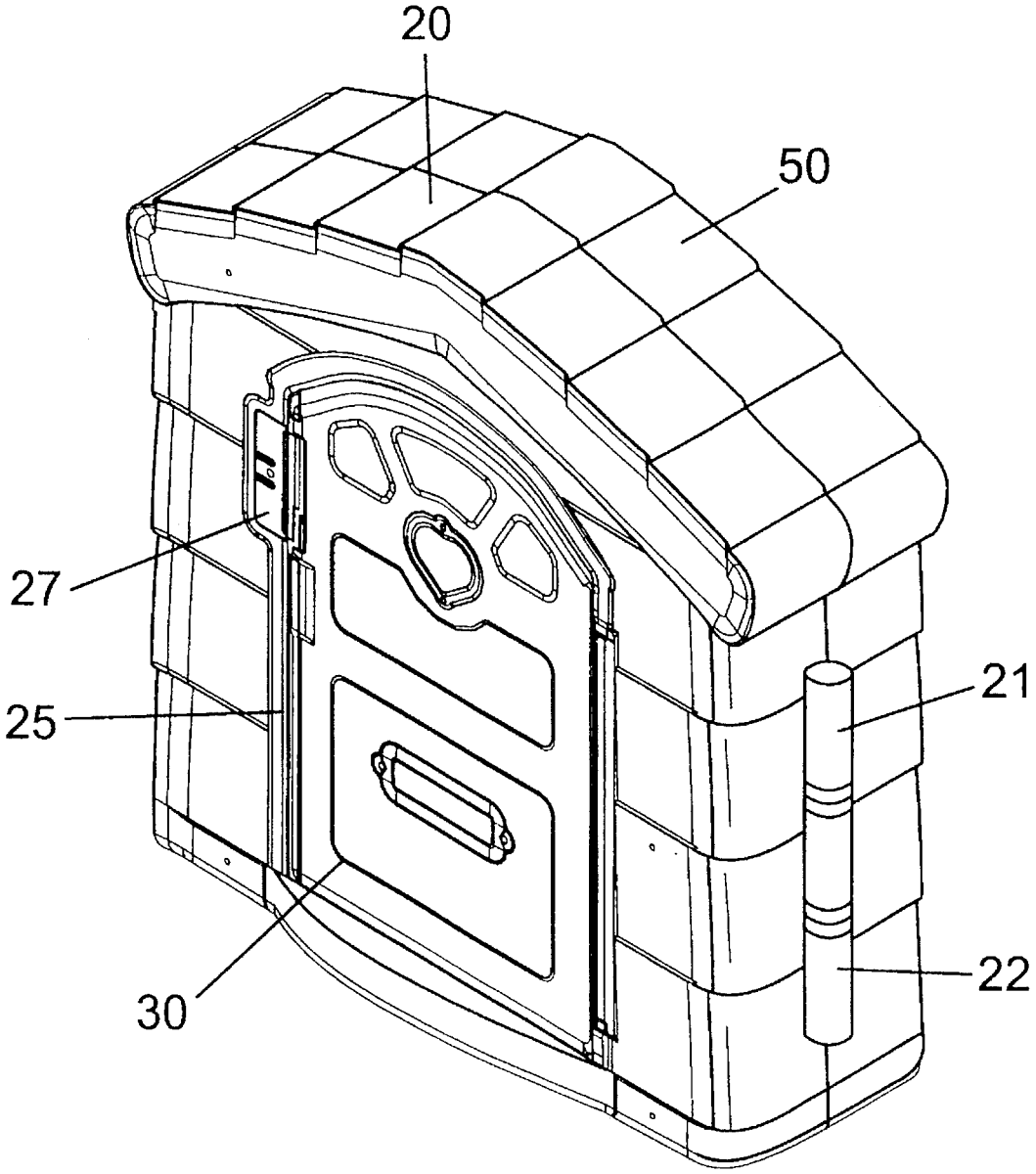

As shown in FIGS. 1A, 1B, and 1C, the front house panel 20 has a door 30 hingedly mounted to the front house panel 20 as shown. A locking bar 40 is slidably mounted on the house panel 20 along a door latch area 27 at an edge of the door frame 25 and is movable vertically between two positions to selectively lock the door 30 closed. Each of the front house panel 20, the rear house panel 50, and the fence panels 60 are detachably interconnectable with each other at their sides. More specifically, any pair of adjacent panels 20, 50 and 60 are detachably interconnectable with each other at their sides by means of the top posts 21, 51 and 61 and lower posts 22, 52 and 62 at one side of each panel that are engageable with a middle post 23, 53 and 63 at the other side of each panel. A pair of toothed locking caps 70 (one attached to each panel by being snapped on the bottom of each top post, and one attached to each panel by being snapped on the top of each middle post), and a threaded connector 90 trapped in a sleeve 80 (mounted in each lower post) are used to lock any pair of adjacent panels together, as will be described in more detail below.

By virtue of the connection system of the invention, any two panels can be connected adjacent each other. Accordingly, the six panels may be interconnected in a variety of arrangements forming an enclosure. Also, since the panels may be interconnected having a wide range of variable angles between the panels, the panels can be connected to construct enclosures having wide variety of polygonal shapes, such as those shown in FIGS. 1A, 1B, 2A and 2B. Further, since the angle between any two panels may be selected and then locked, the configuration or shape of the entire apparatus may be chosen and then fixed, making the overall enclosure sturdy.

The connection system of the invention also facilitates disassembly of the enclosure—all six panels may be disconnected from each other. In the compact storage mode described in more detail below and illustrated in FIGS. 2C, 2D and 2E, the four fence panels 60 may be stacked in pairs and nested between the from house panel 20 and the rear house panel 50. Next the front house panel 30 and the rear house panel 50 may be connected to each other at both sides to trap the fence panels 60 between them, thus locking the entire assembly into a compact unit for storage or portability.

Although the number of possible configurations and shapes into which the panels may be assembled is very large, three assembled modes will now be described including two enclosure modes (a "play yard" mode and a "play house" mode) and the compact storage mode.

Figure 2A:
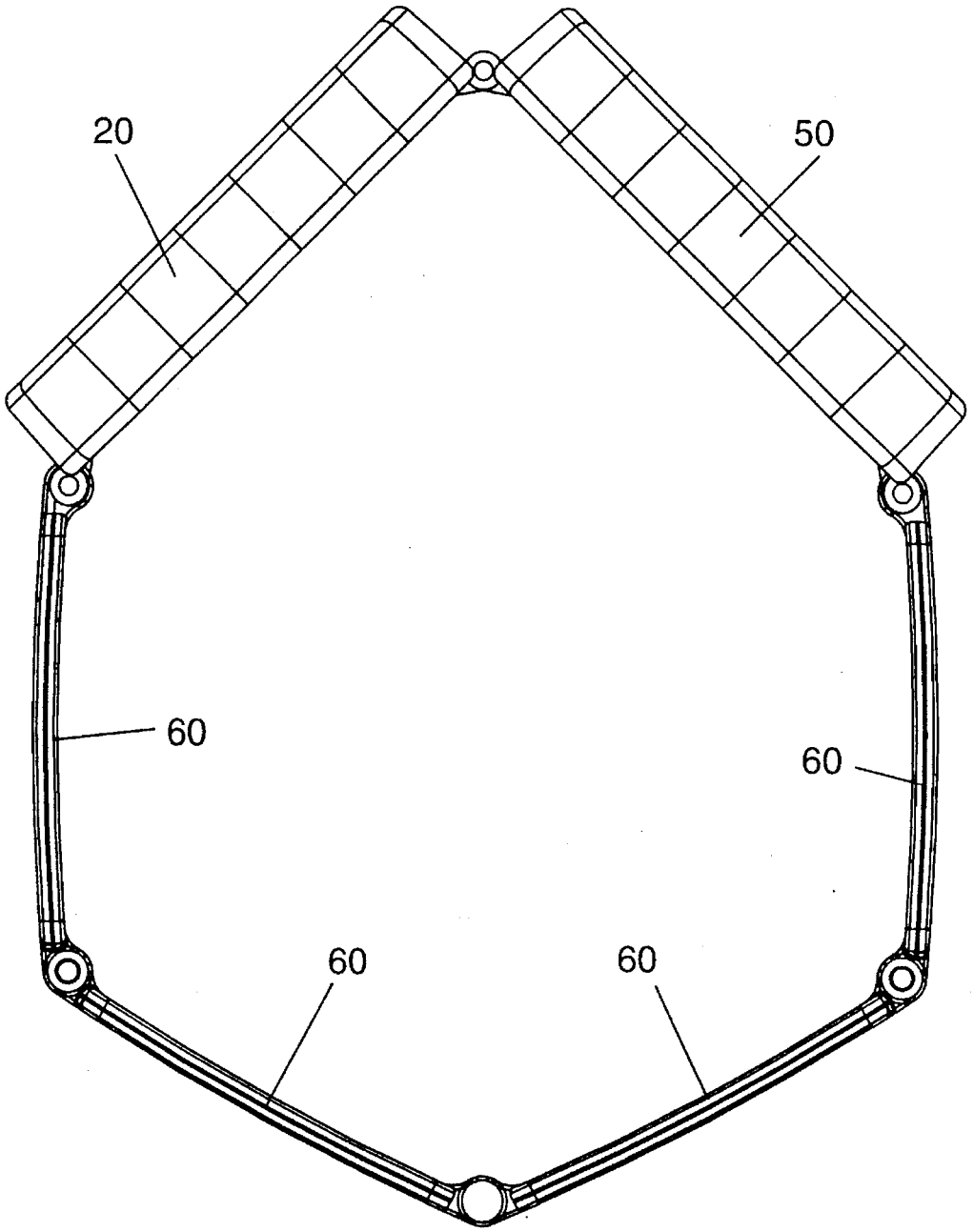
FIGS. 2A, 2B and 2C are top views showing the apparatus in the play yard mode, play house mode, and compact storage mode, respectively.

In the play yard mode illustrated in FIGS. 1A and 2A, the panels are configured to surround a large hexagonal area for an infant or child to play in. The door 30 may be locked by sliding the locking bar 40 into the locked position to provide a secure enclosure, as discussed in more detail below.

Figure 2B:
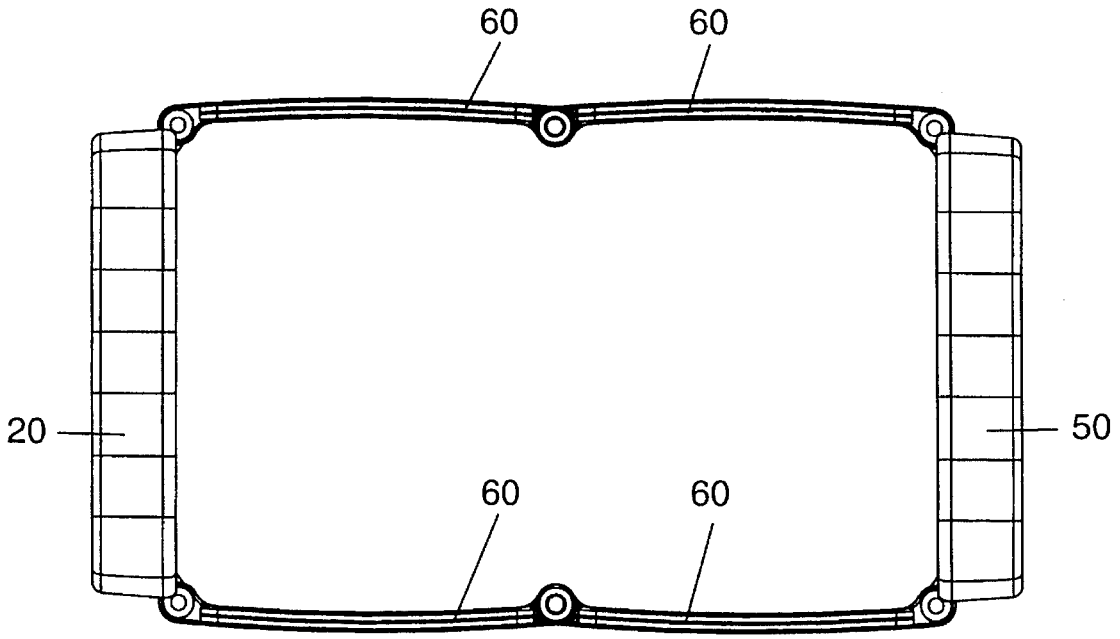

In the play house mode illustrated in FIGS. 1B and 2B, the panels are configured to provide a rectangular house-themed play area that is suitable for infants when the door is in the locked position but also may be especially suitable for older children when the door is in the unlocked position, thereby allowing the older children the ability to enter and exit the play house enclosure.

Figure 6A:
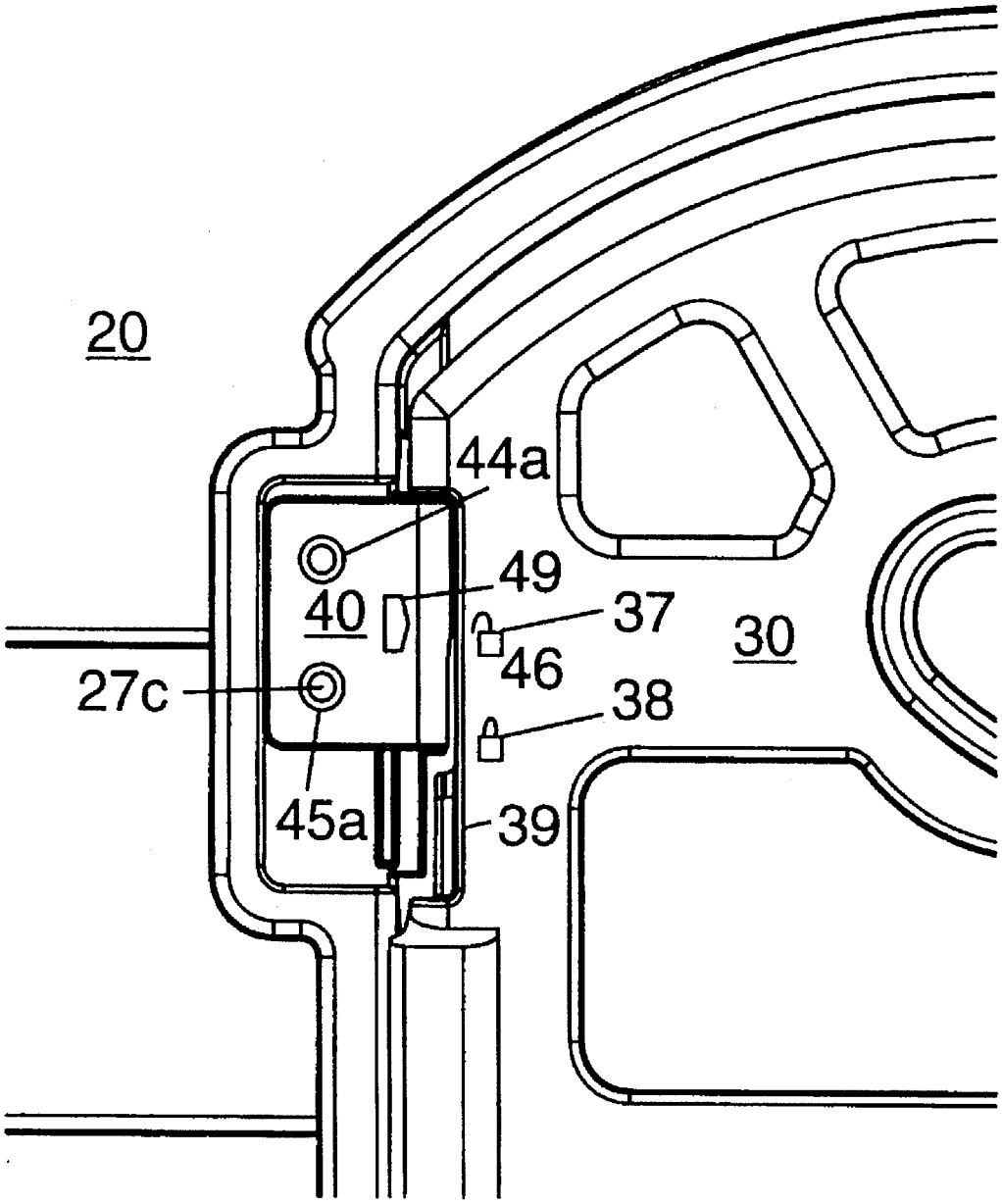
FIGS. 6A and 6B are front and rear assembly views respectively showing the front house panel, the door, and the locking bar.
Figure 6B:
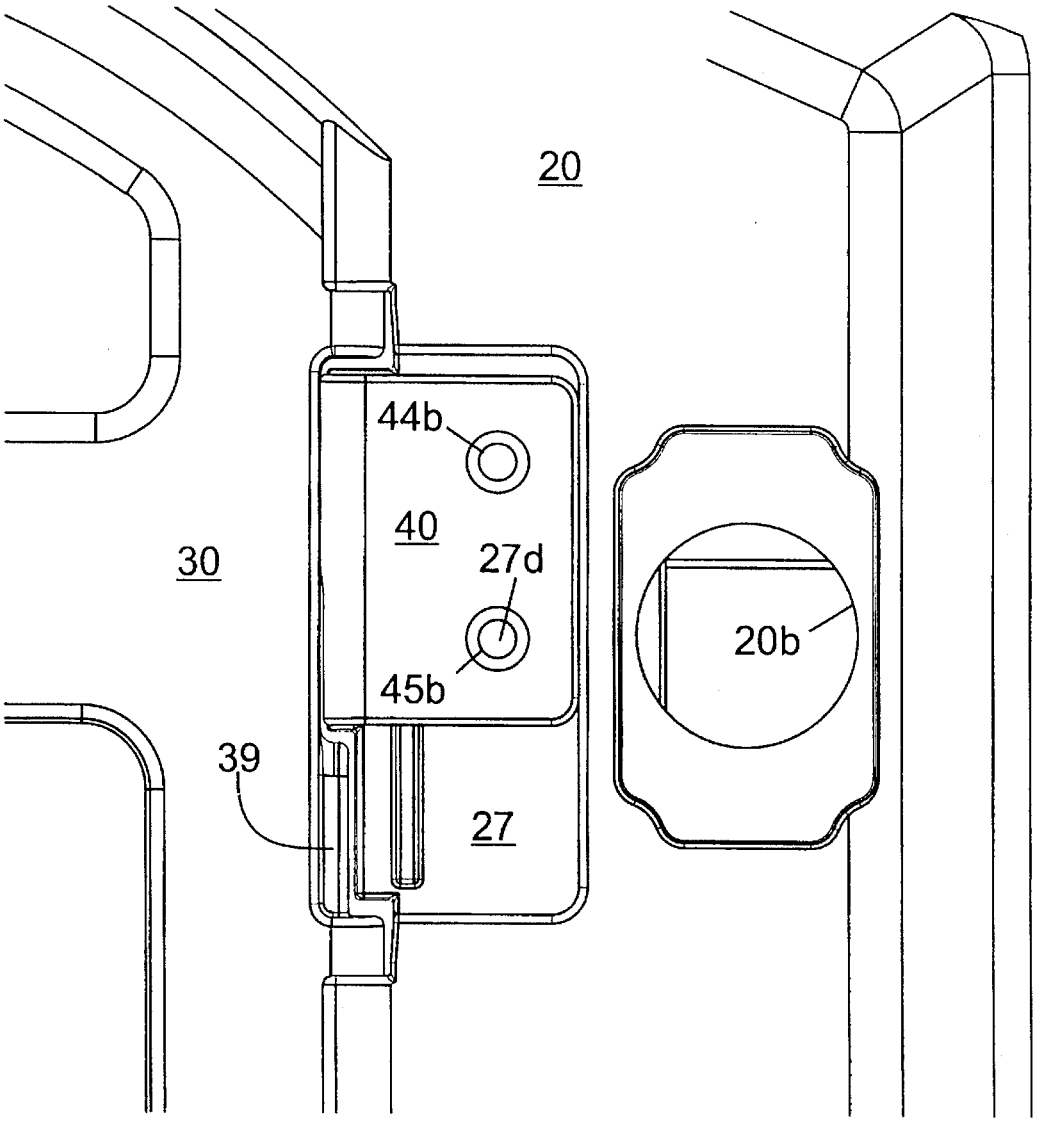
Figure 7A:
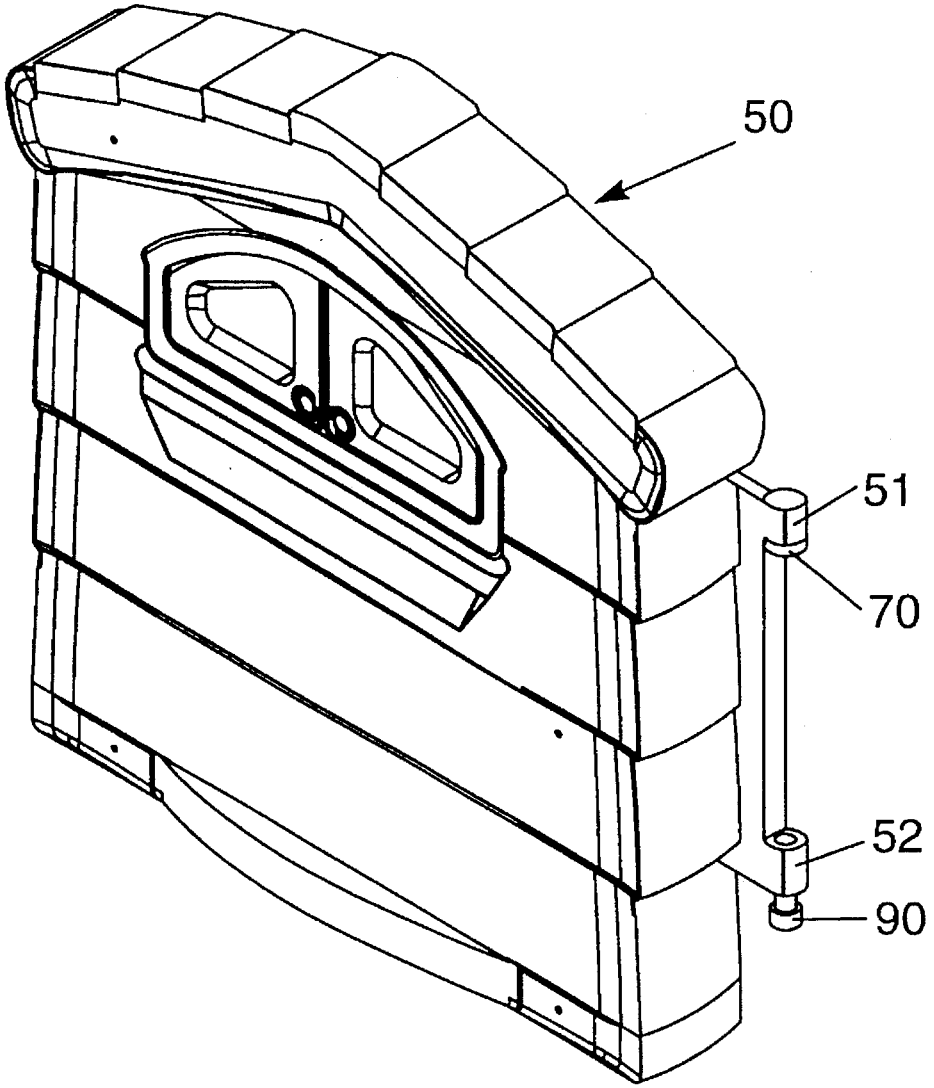
FIGS. 7A, 7B, 7C, 7E and 7F are perspective, front, rear, right side and left side views of the rear house panel.
Figure 7B:
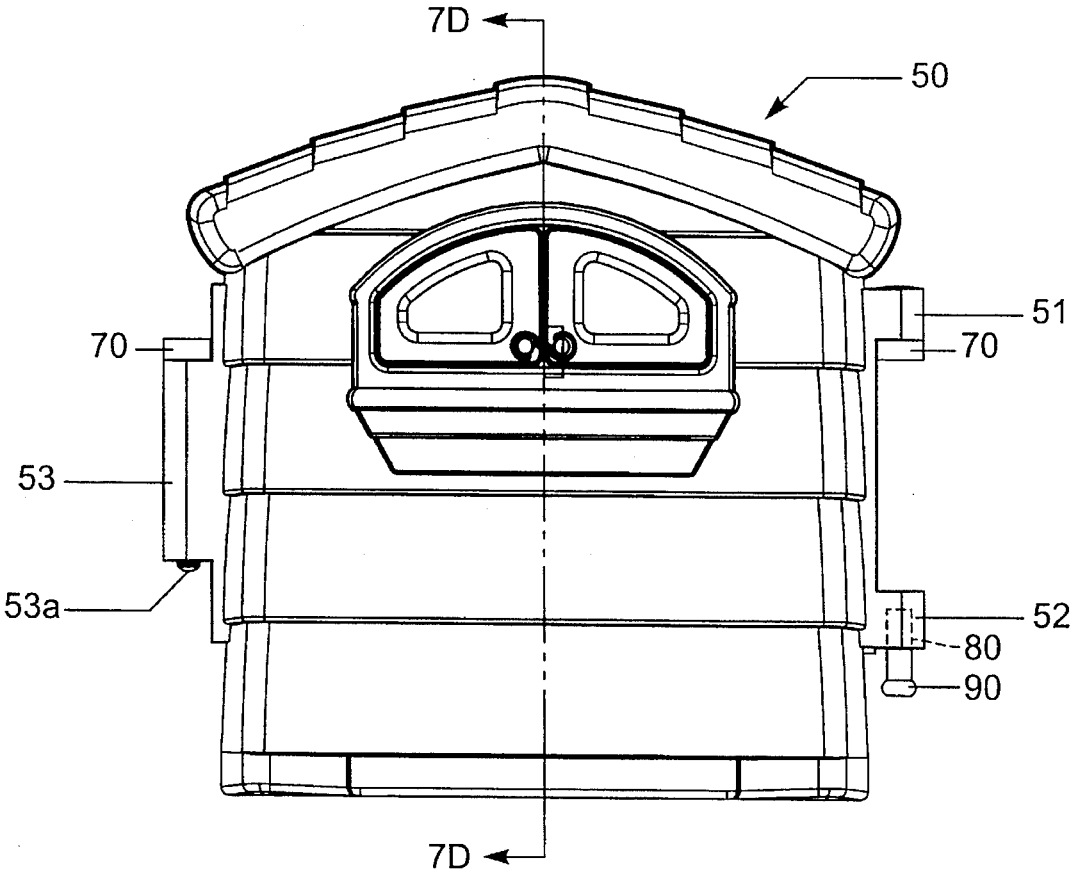
Figure 7C:
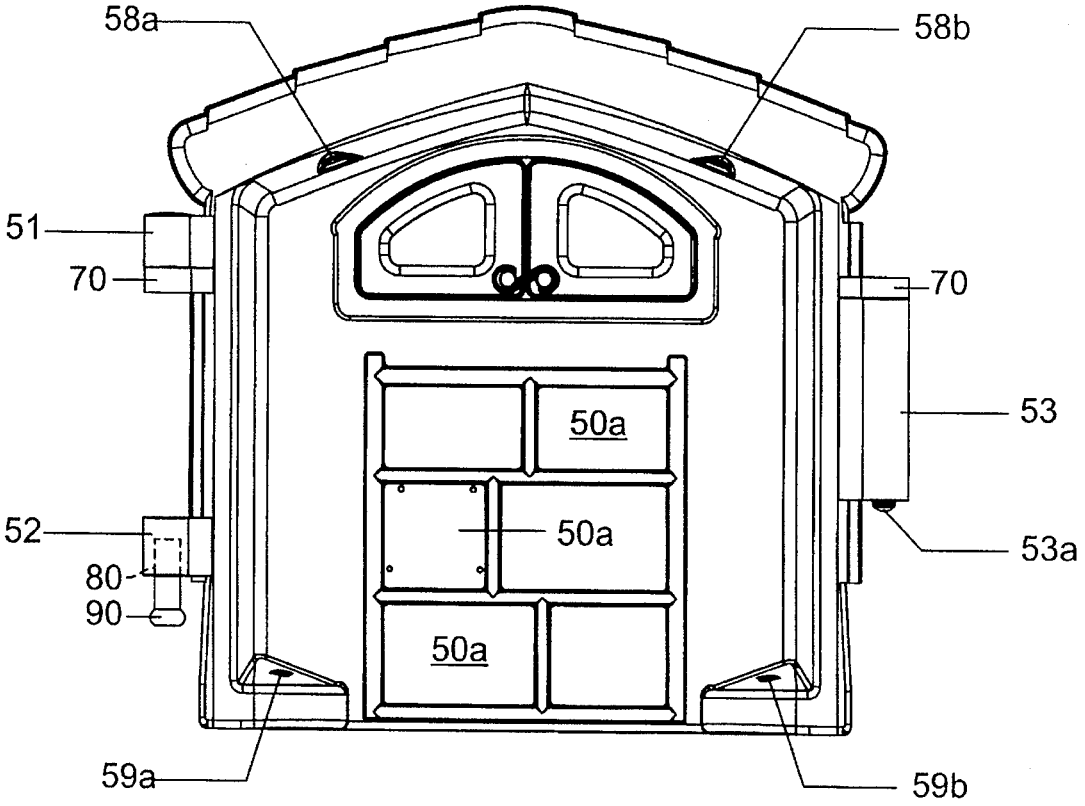
Figure 7D:
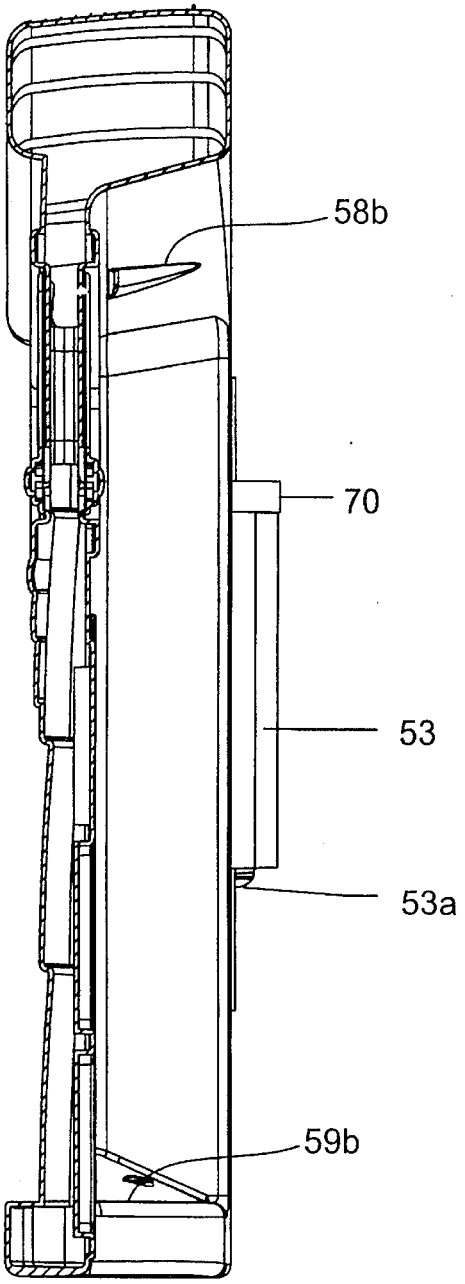
FIG. 7D by a cutaway view taken along line 7D in FIG. 7B.
Figure 7E:
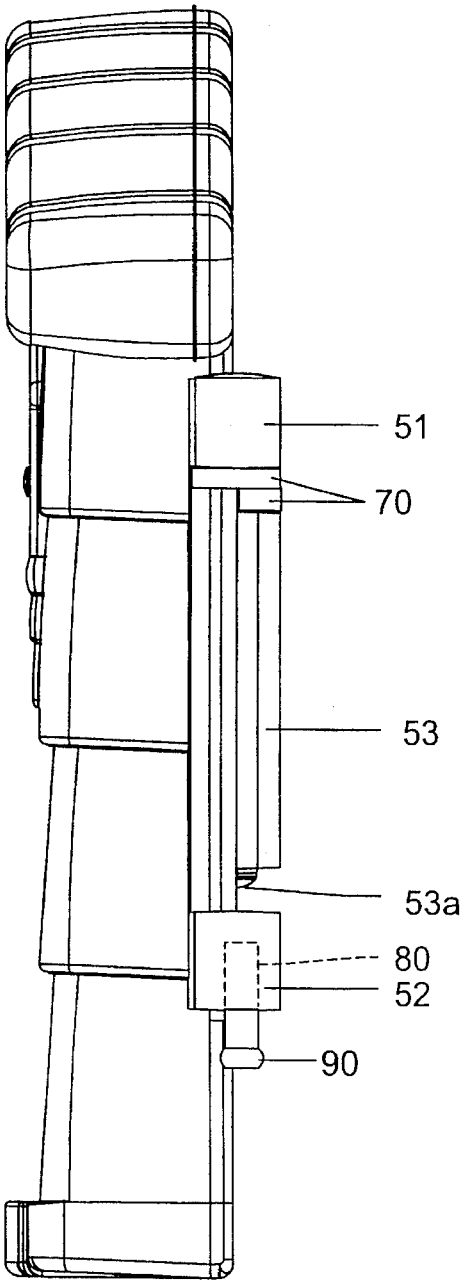
Figure 7F:
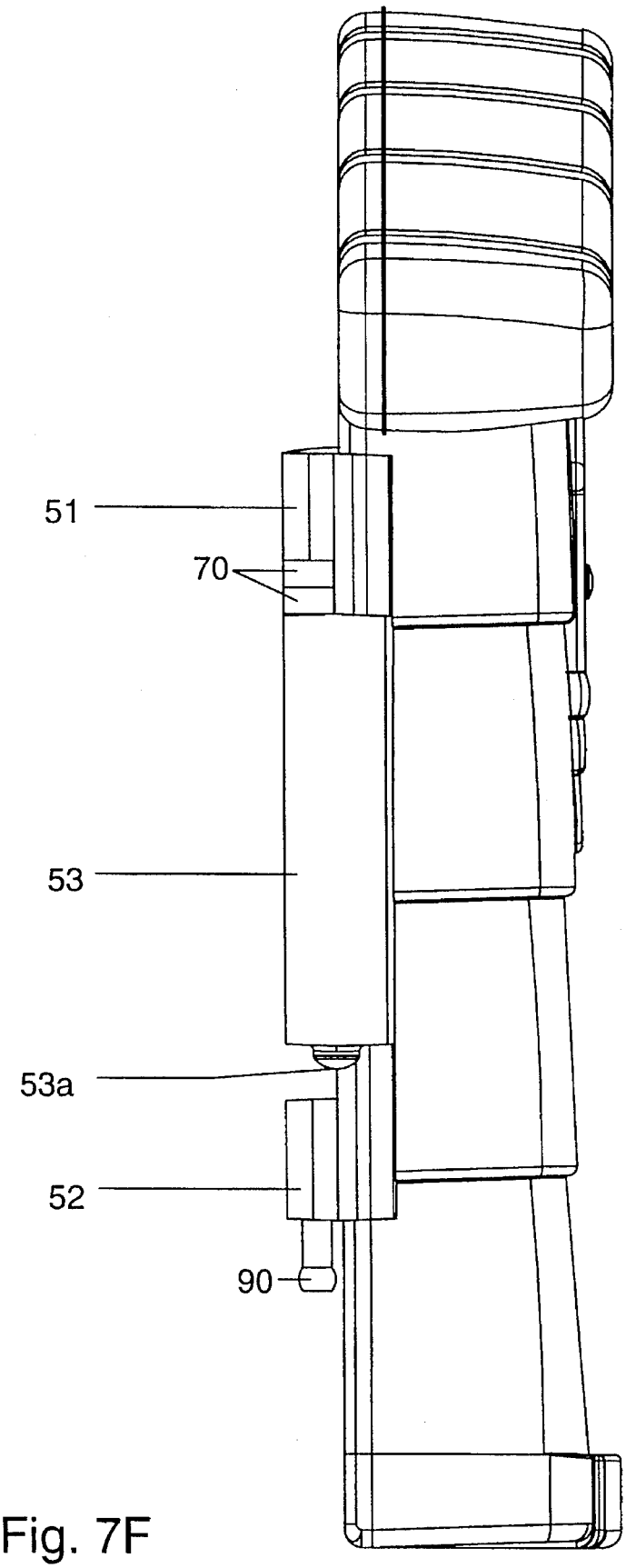
Figure 8A:
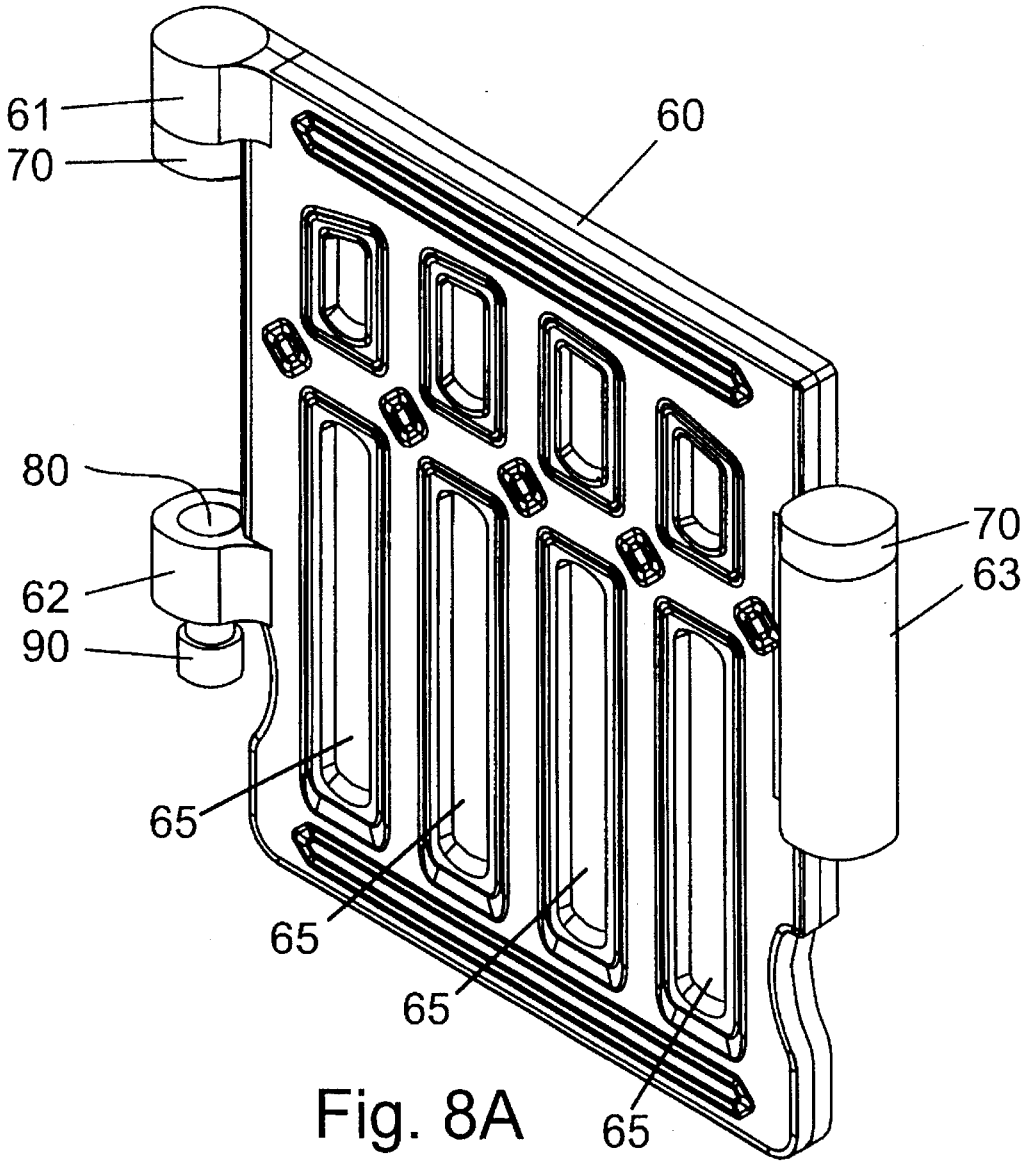
FIGS. 8A, 8B, 8C, 8D and 8F are perspective, front, rear, right side, and bottom views of a fence panel.
Figure 8B:
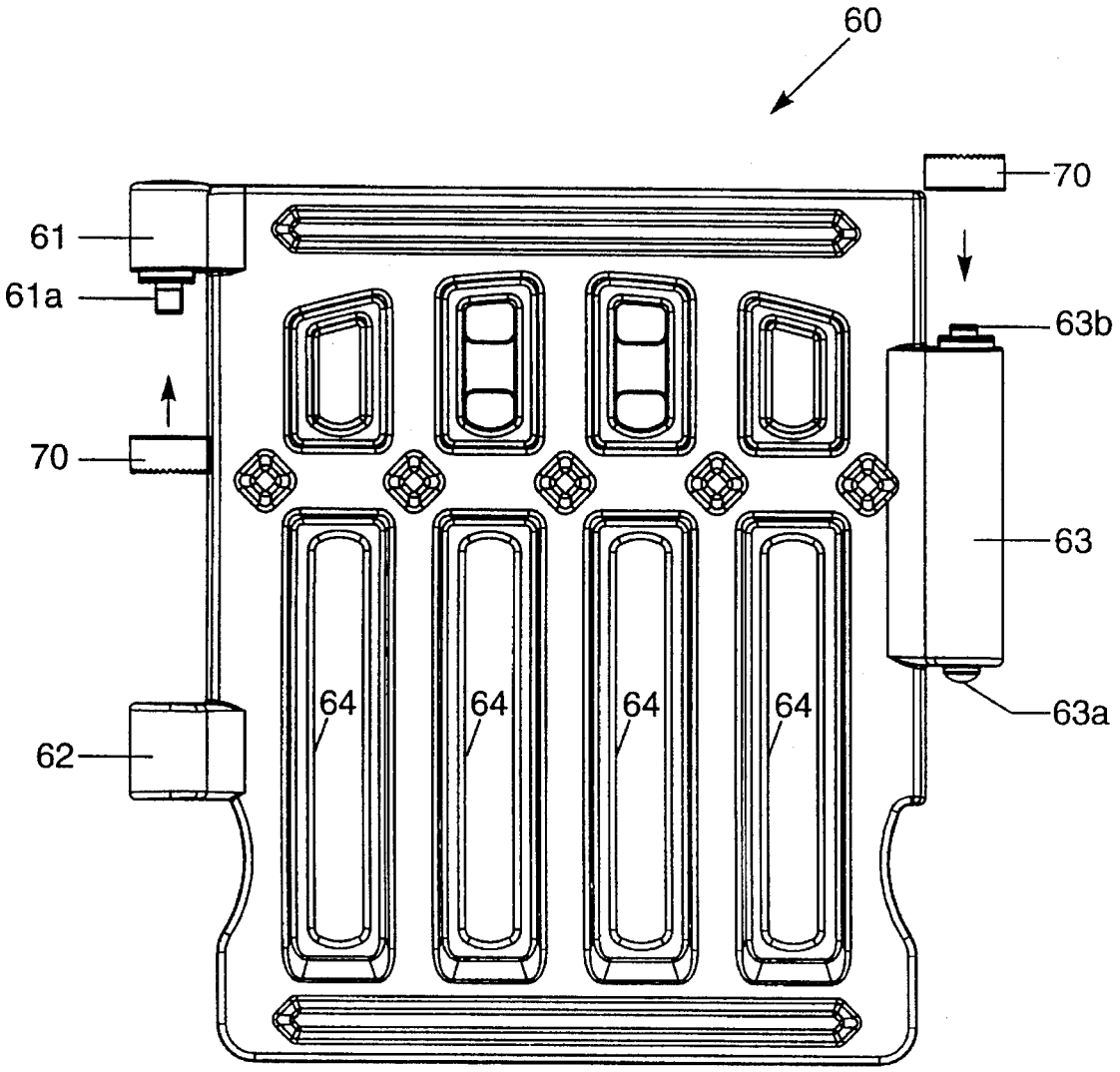
Figure 8C:
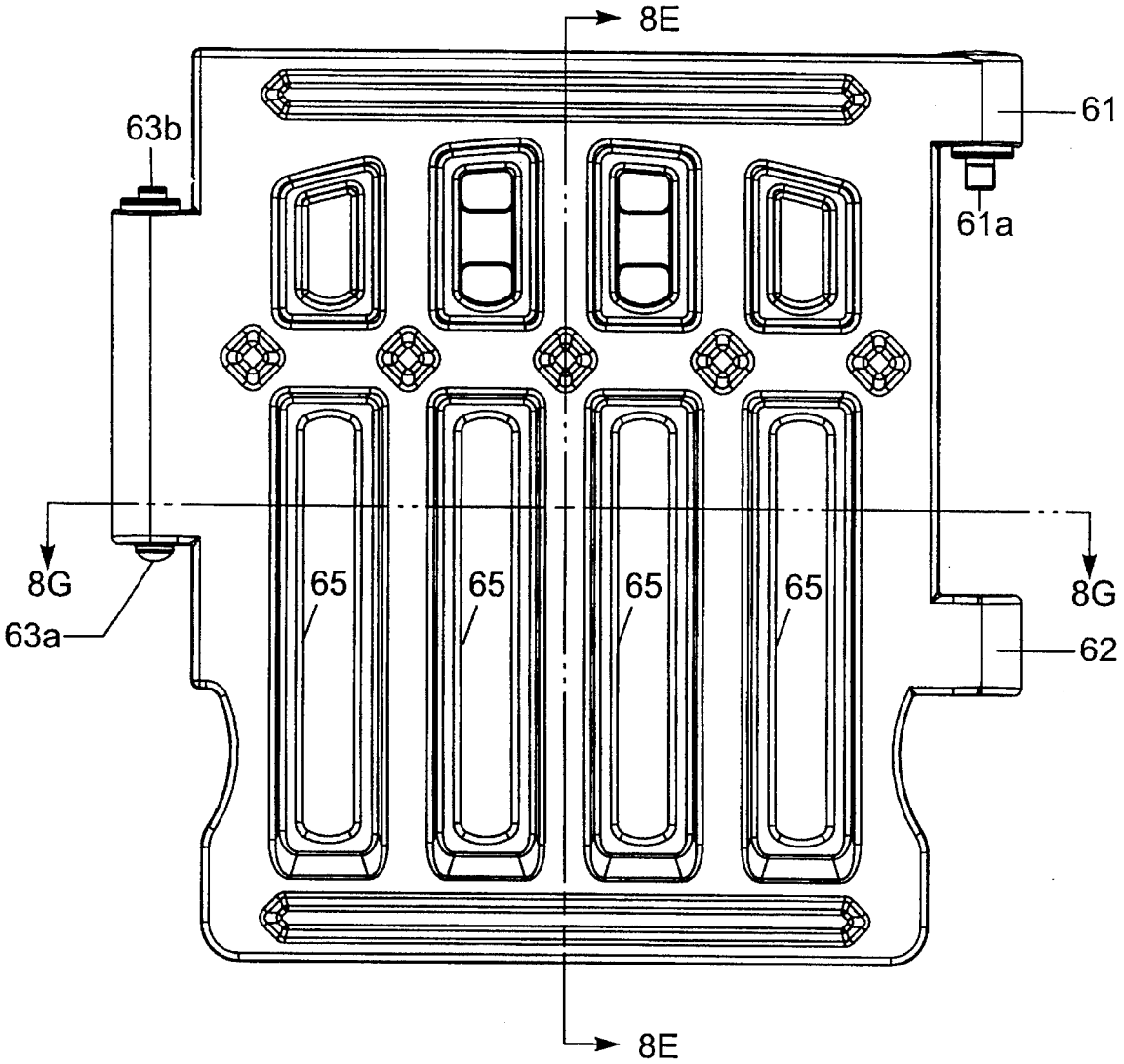
Figure 8D:
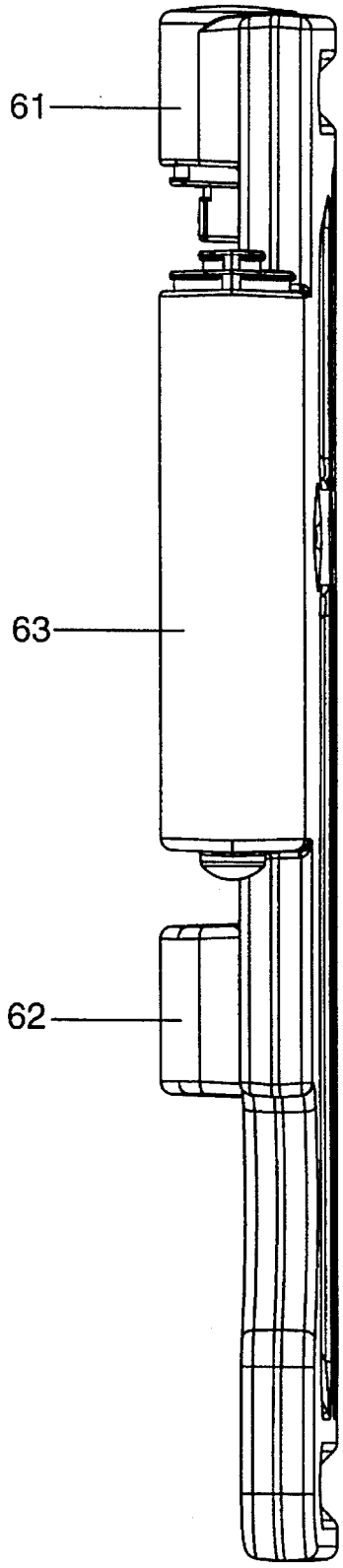
Figure 8E:
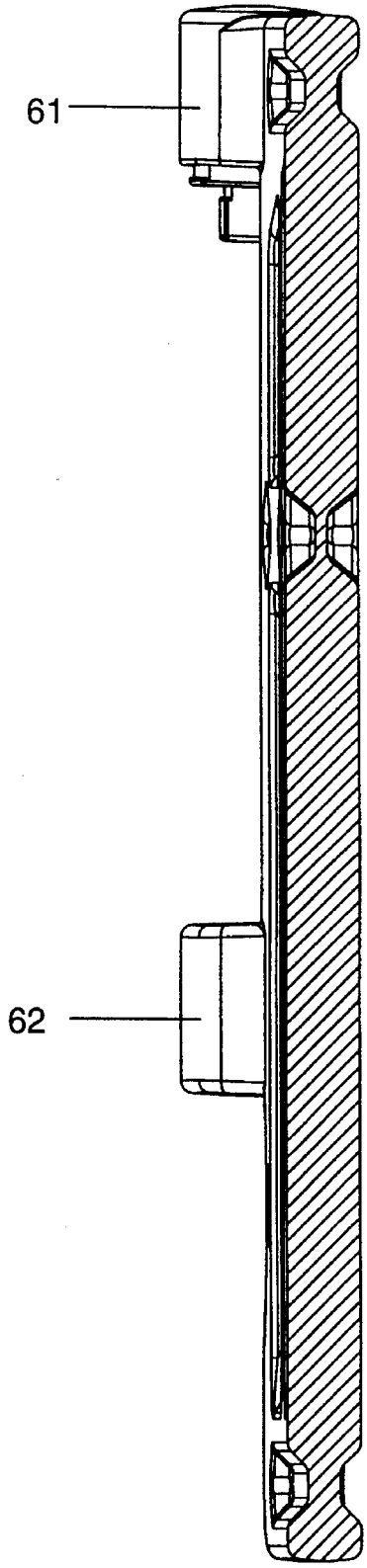
FIGS. 8E and 8G are cross-sectional views taken along lines 8E and 8G in FIG. 8C respectively.
Figure 8F:
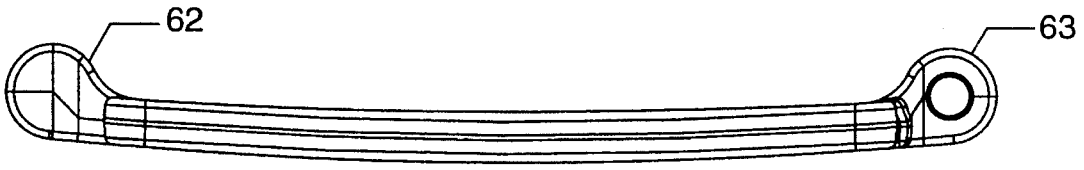
Figure 8G:
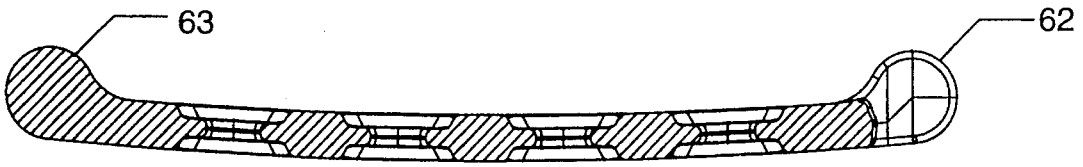

In either of the above-described enclosure modes, the door may only be unlocked by simultaneously depressing the spring-loaded buttons 27*c* and 27*d* on both the front and rear of the front house panel 20. The lock mechanism illustrated in FIGS. 6A and 6B is described in more detail below. Since the outer button 27*c* is not reachable by an infant from inside (due to the height and reach required to reach over the height of the door 30 and the house panel 50), the infant is securely prevented from leaving the enclosed play yard or play house area.

Figure 2E:
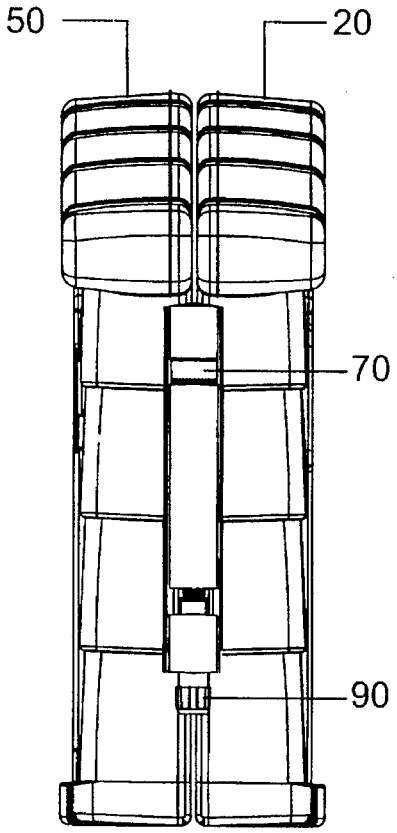
FIGS. 2D and 2E are a side partially cut-away view and a side view showing the apparatus in the compact storage mode.
Figures 2D, 2F:
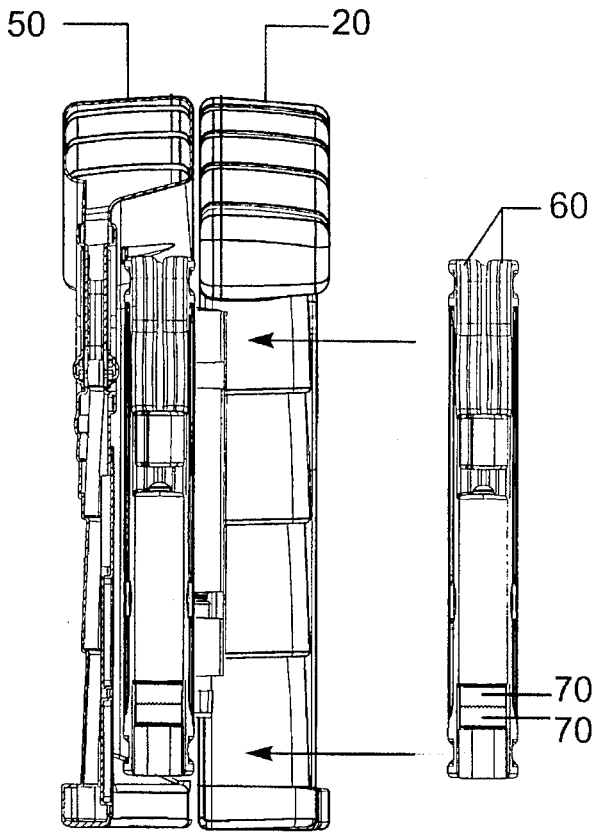
FIG. 2F is a side view two fence panels connected together to fit in the compact storage mode.
Figure 2C:
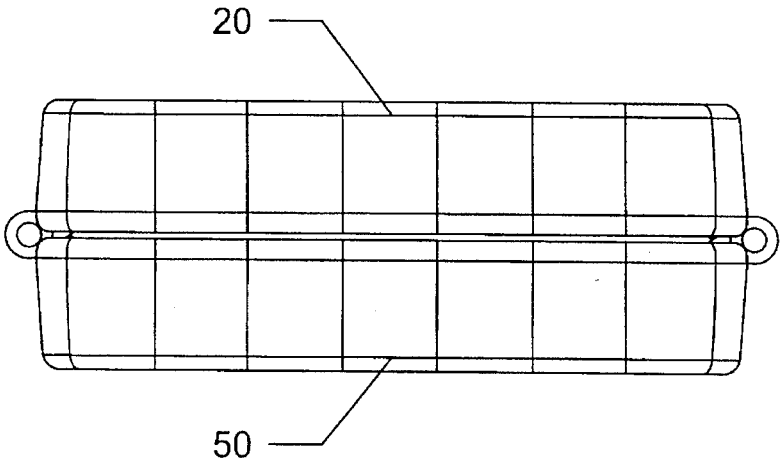
Figure 3A:
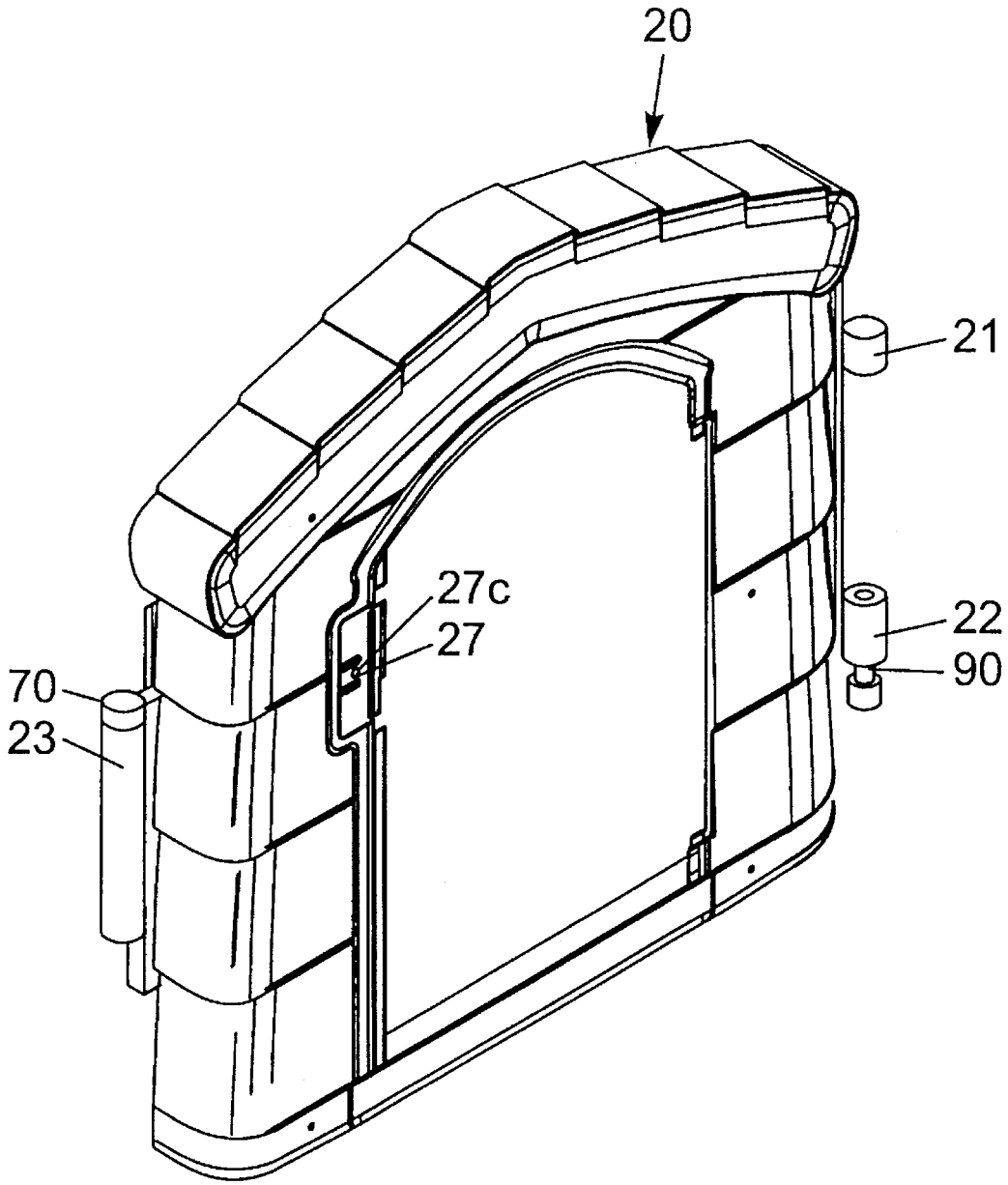
FIGS. 3A, 3B, 3C, 3D and 3E are perspective, front view, rear view, right side and left side views, respectively, of the front house panel.
Figure 3B:
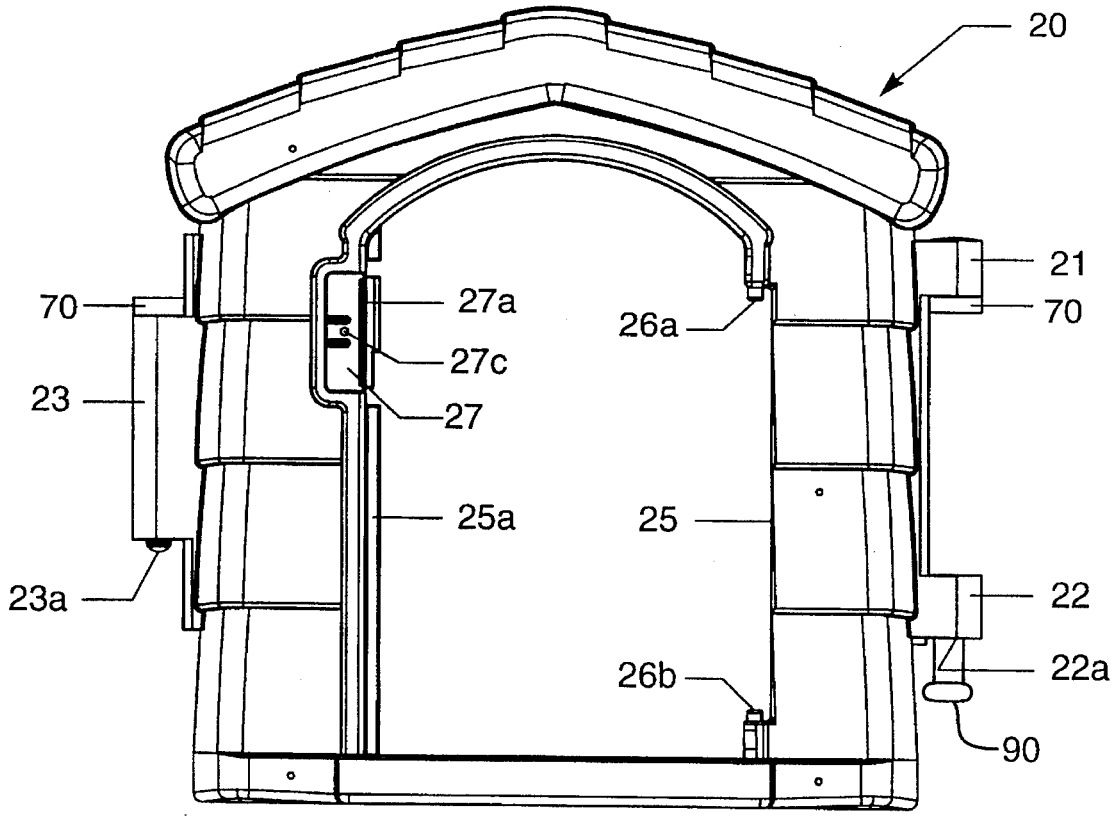
Figure 3C:
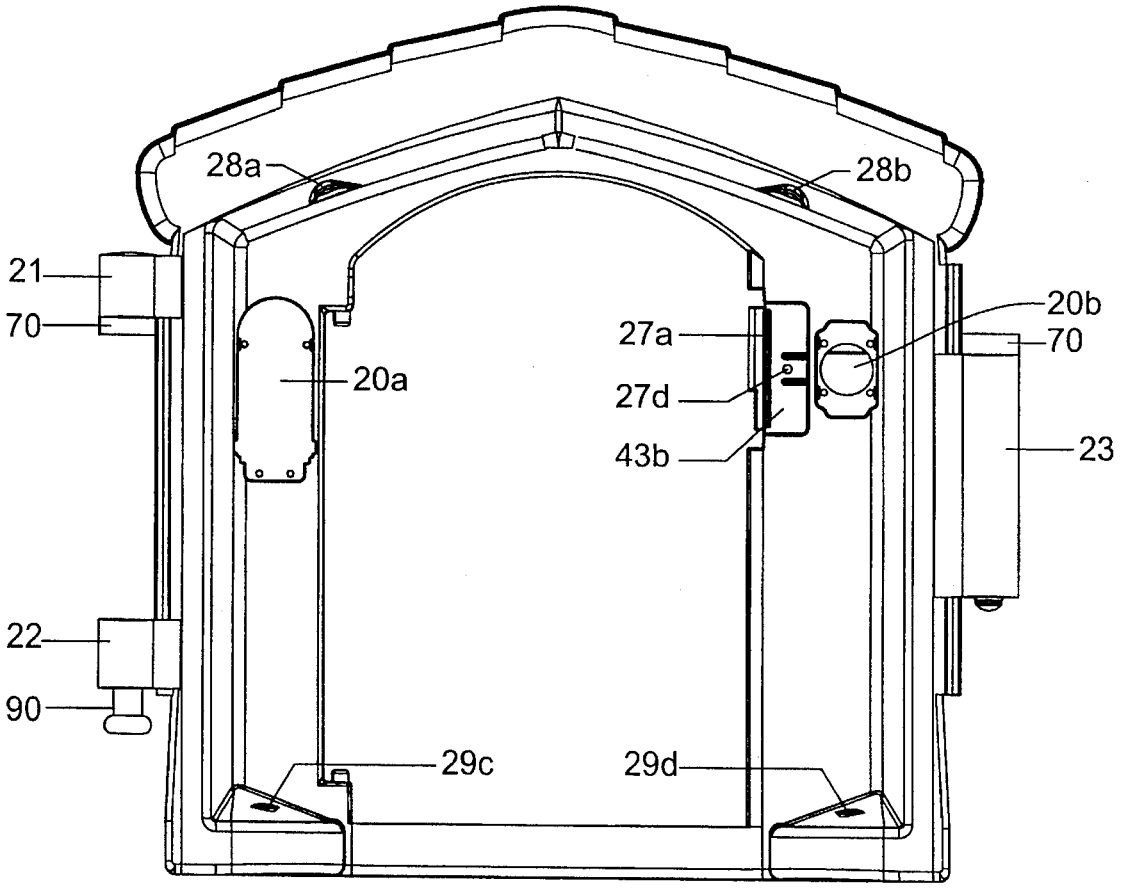
Figure 3D:
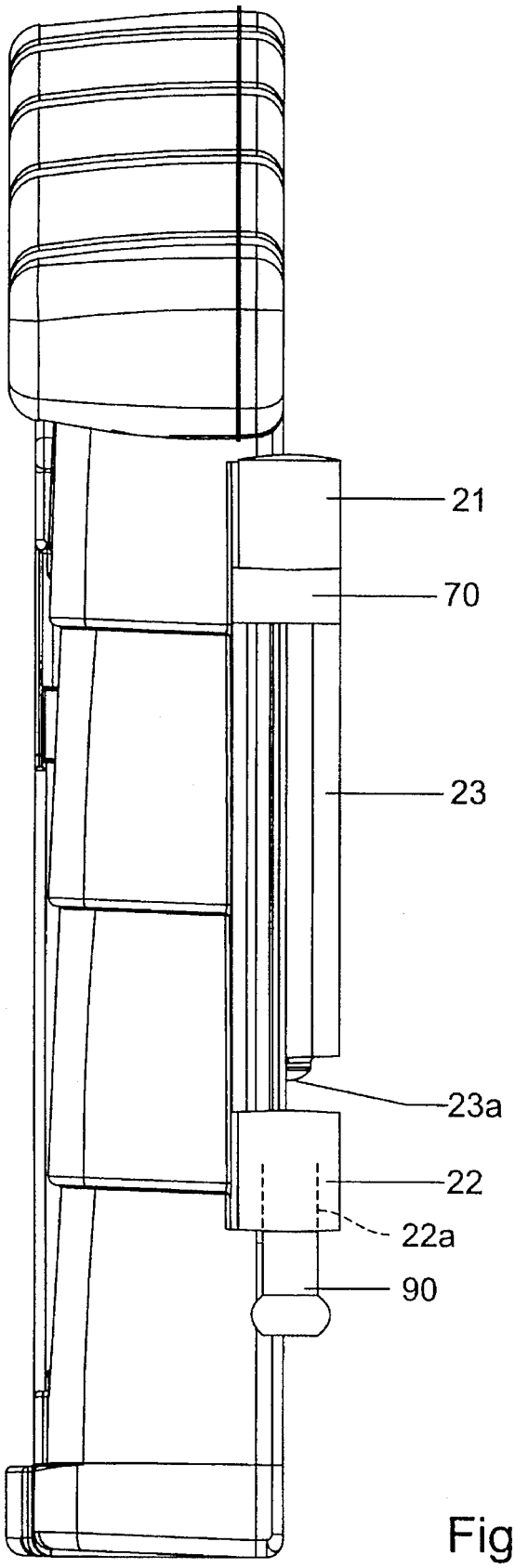
Figure 3E:
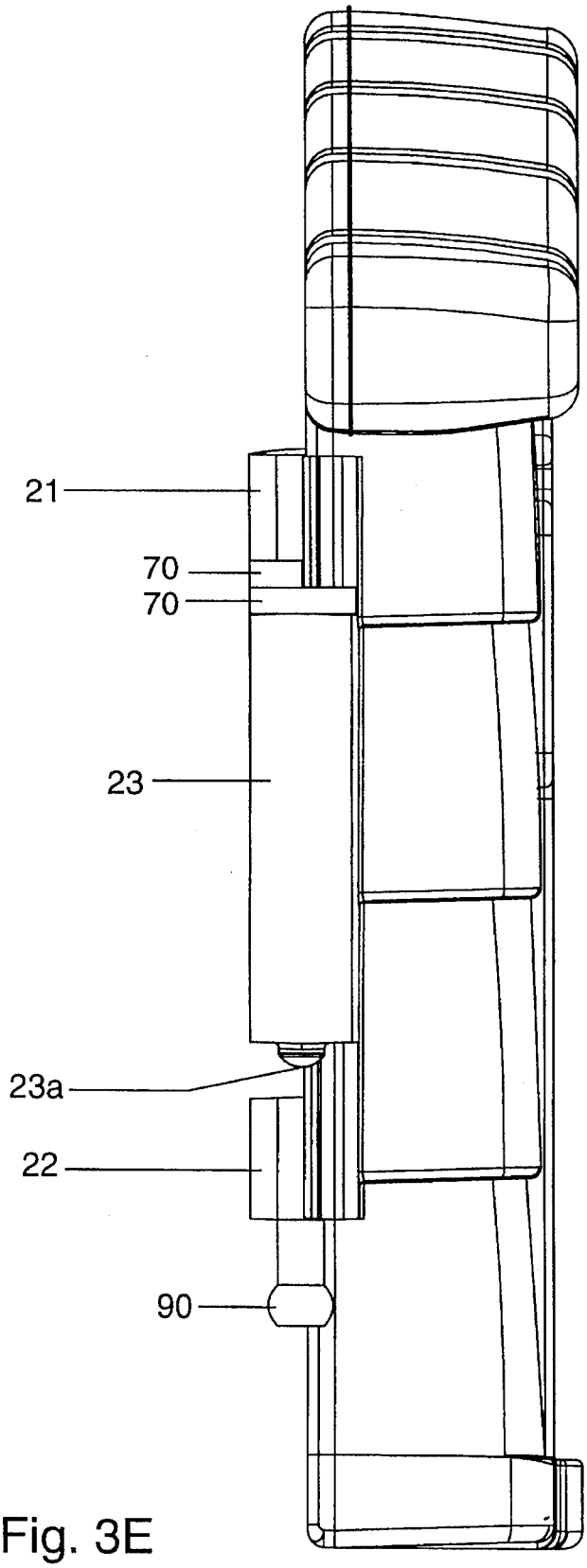
Figure 4A:
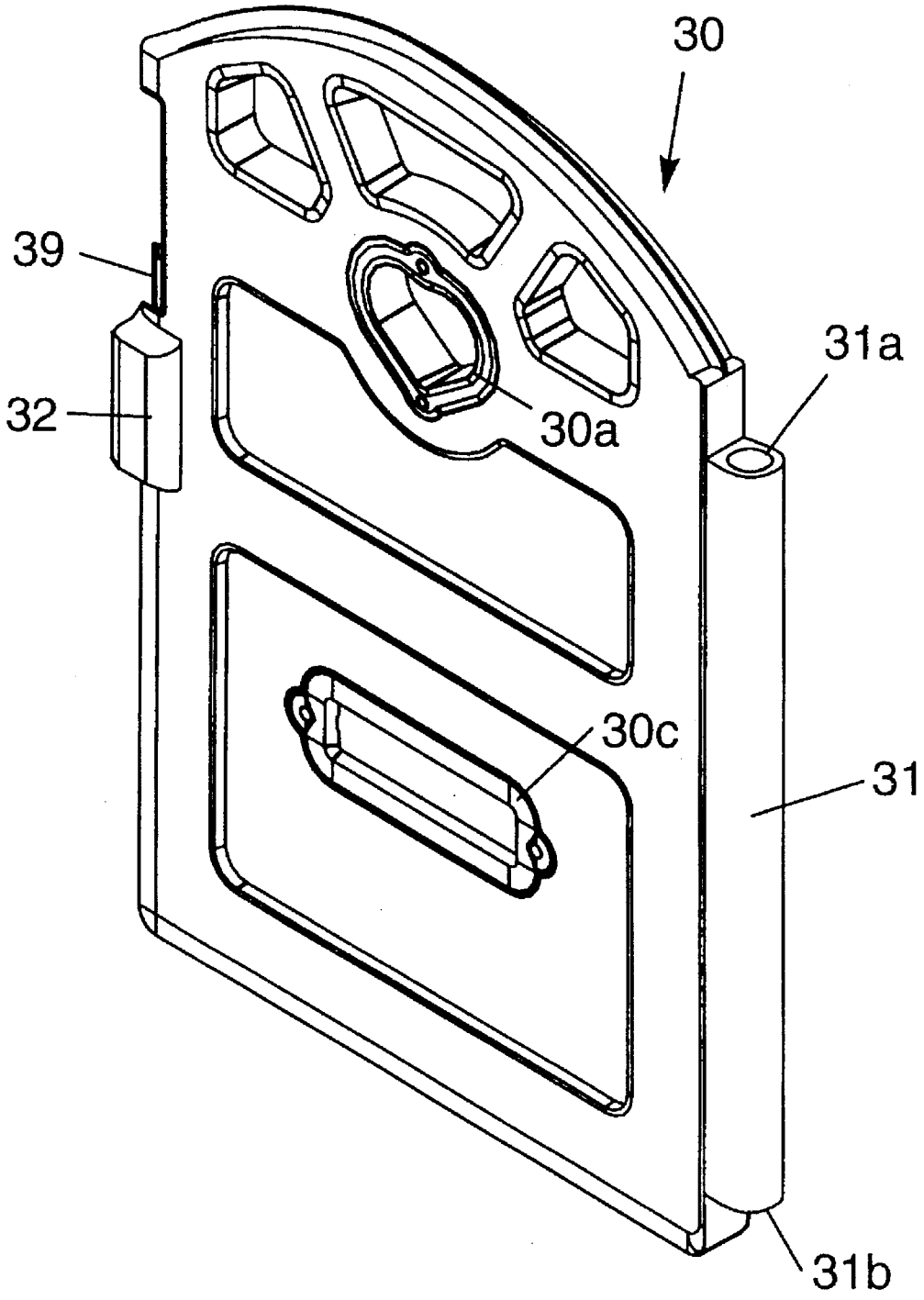
FIGS. 4A, 4B, 4C, 4D and 4F are perspective, front, rear, right side, and top, views of the door panel.
Figure 4B:
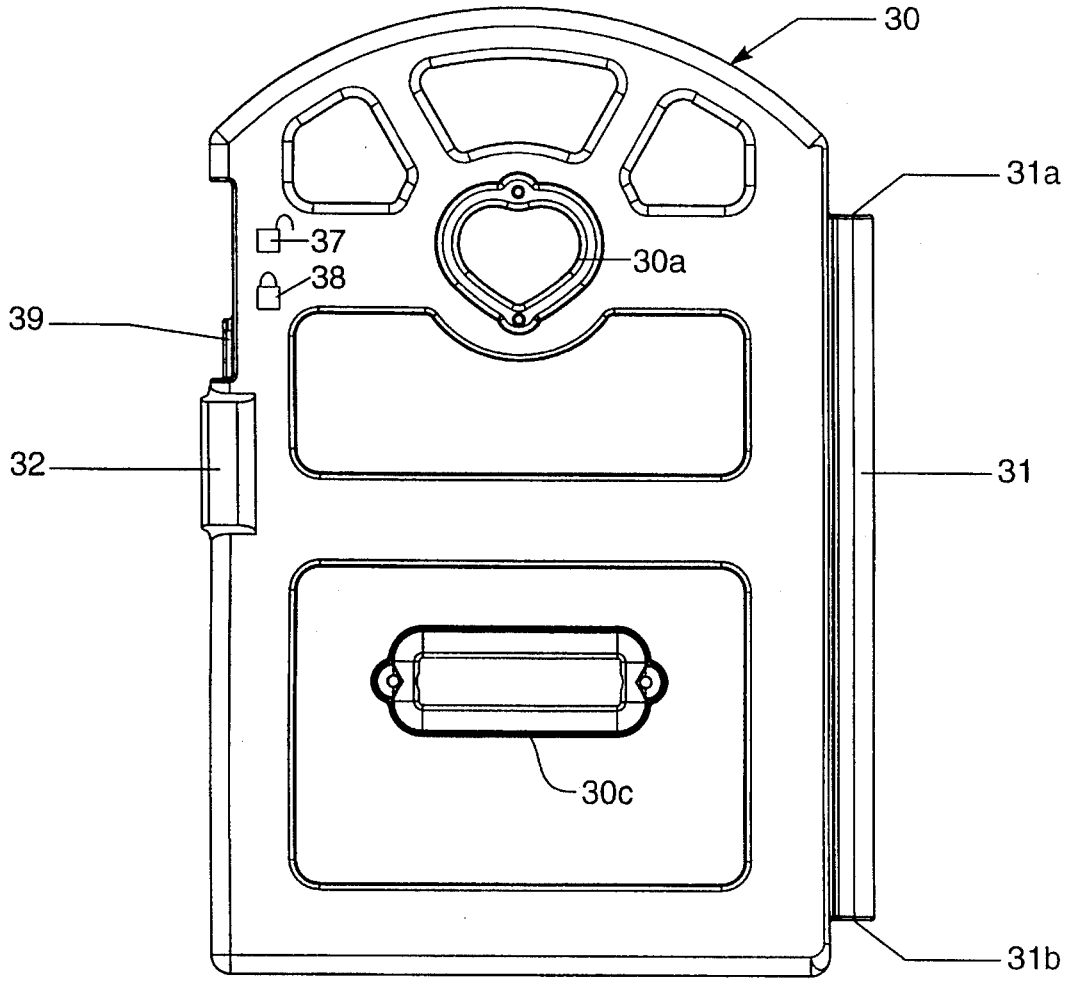
Figure 4C:
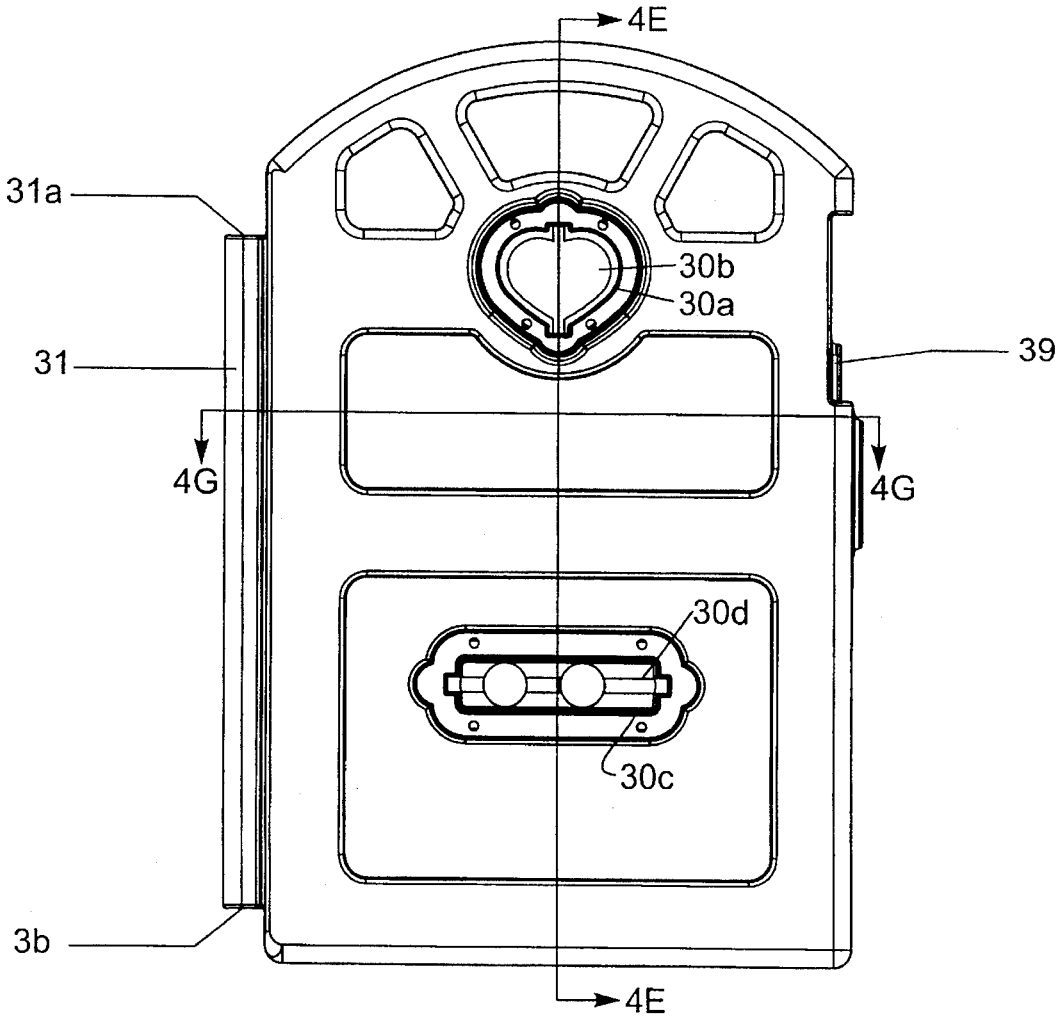
Figure 4D:
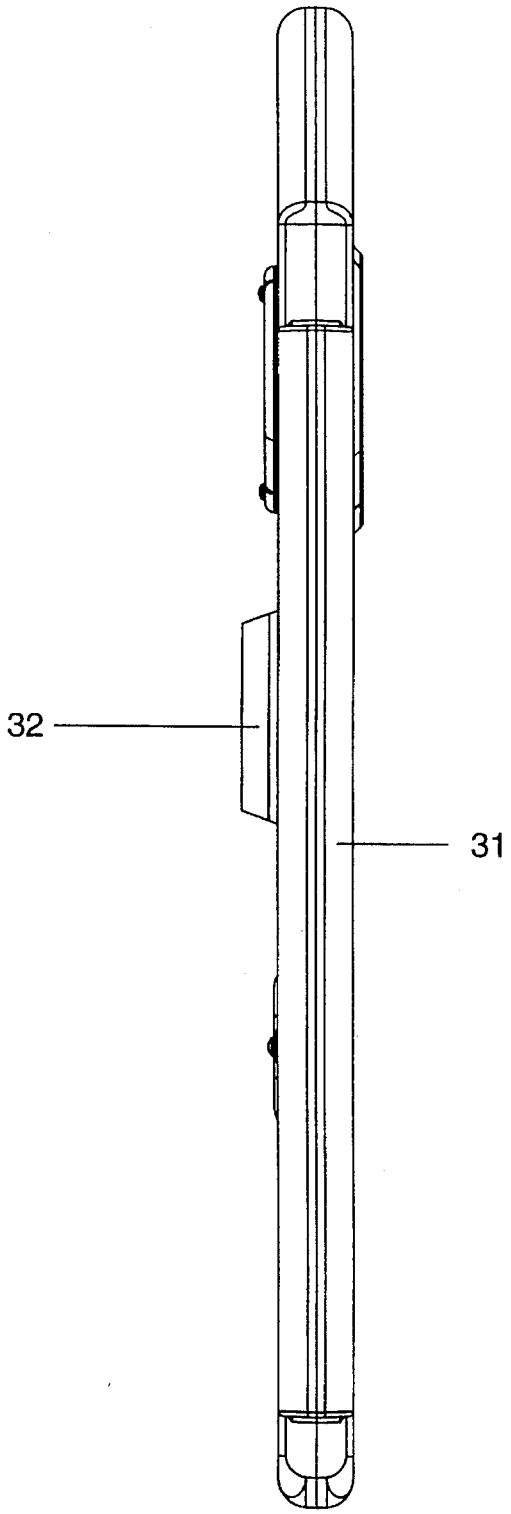
Figure 4E:
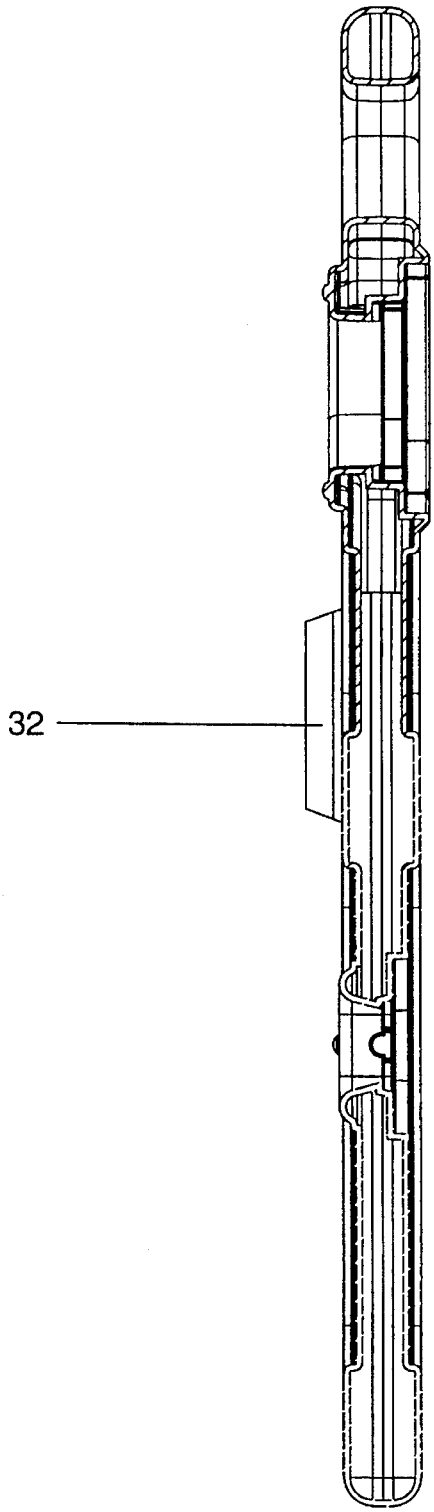
FIG. 4E is a cutaway view taken along line 4E in FIG. 4C.
Figure 4F:
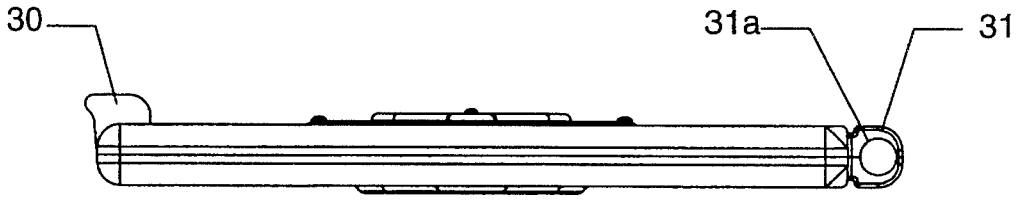
Figure 4G:
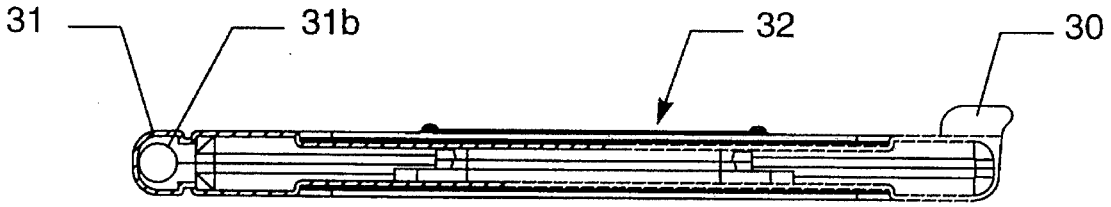
FIG. 4G is a cutaway view taken along line 4G in FIG. 4C.

In the compact storage mode illustrated in FIG. 2C, 2D and 2E, two pairs of connected fence panels 60 are placed, one pair in each house panel, and sandwiched between the front house panel 20 and the rear house panel 50. Each pair of panels may be positioned as shown in FIGS. 2F and 2D. (In the preferred embodiment the panels are in an upside-down orientation but they might be right side up in alternative embodiments). The front house panel 20 is then connected to the rear house panel 50 at both sides using the same connection method as the other panel connections, so that the entire assembly is compactly held together for portability and storage. The detents 28*a*, 28*b*, 29*c* , and 29*d* on the front house panel 20 and the detents, 58*a*, 58*b*, 59*a* and 59*b* on the rear house panel 50 fit against the corners of the fence panels 60 to hold them in place when they are sandwiched between the front and rear house panels so that they do not rattle or shift position.

Each of the various component parts of the apparatus will now be individually described in greater detail, beginning with the front house panel 20. Referring to FIGS. 3A through 3E, the front house panel 20 has an upper post 21 and a lower post 22 located at one side, and a middle post 23 located at the other side of the front house panel 20. The upper post 21 has a locking cap 70 (described in more detail below, and illustrated in FIGS. 10A, 10B and 10C) mounted to its lower surface. A flat side 71 of the locking cap 70 is facing the lower surface of the upper post 21 with a toothed side 72 of the locking cap pointing downward. Middle post 23 is located on the other side of the front house panel 20 and has mounted on its top surface another locking cap 70 mounted with the flat side 71 facing the top end of the middle post 23 and the toothed side 72 of the locking cap 70 pointing upward. A lower post 22 is located at the same side of the front house panel 20 as the upper post 21, and has a hole 22*a* drilled therethrough for supporting a sleeve 80 that is snap-fit into the hole 22*a*. The sleeve 80 supports a threaded knob 90 capable of a threaded engagement with the sleeve 80. As described in more detail below, the knob 90 is supported in the sleeve 90 in such a way that the knob 90 freely engages the sleeve 80, but cannot fully disconnect from, or fall out of, the sleeve 80. A domed surface 23*a* is provided on the lower surface of the middle post 23 and is shaped for contacting the top end of the threaded knob 90.

The front house panel 20 also includes a door frame 25 with upper and lower hinges 26*a* and 26*b*. A door latch area 27 is provided for slidably supporting a door locking bar 40 as discussed in more detail below with reference to the door locking bar 40. The detents 28*a*, 28*b*, 29*c* and 29*d* provided on the inner side of the front house panel 20 engage with the corners of the fence panels 60 to hold the fence panels 60 in place when they are nested between the front house panel 20 and the rear house panel 50 in the compact storage mode. A mounting point 20*a* is provided for mounting a mirror or similar decoration. Also, an aperture 20*b* is provided to permit insertion during manufacturing of the spring-loaded two sided button 27*c* and 27*d* discussed in more detail below. The aperture 20*b* may then be covered by another decoration or play item or activity item. The decorations and/or play items may be snapped into place.

The door 30 shown in FIGS. 4A through 4G, is mounted within the door frame 25 so that it may swing outwardly. A hinge post 31 is provided on one edge of the door 30 and includes upper and lower sockets 31*a* and 31*b* for receiving upper and lower hinges 26*a* and 26*b*, respectively, to provide the hinge mounting. A door jamb 25*a* is provided on the door frame 25 so that the door only swings outwardly. An appropriate amount of interference maybe provided between the side or bottom edges of the door 30 and the door frame 25, so that the door is snugly held closed, but may also be easily swung open from the closed position when unlocked. A handle 32 is provided on the outside of the door 30 to facilitate opening it. As described in more detail below, a rib 39 is engageable by the locking bar 40 to selectively lock the door 30 closed. The door may include decorations, play items and/or activity items, such as an aperture 30*a* with a heart-shaped decoration 30b mounted to swivel therein and an aperture 30*c* having an axle 30*d* with beads slidably mounted thereon.

The locking bar 40 illustrated in FIGS. 5A through 5D, 6A and 6B, is slidably mounted for vertical travel on the front house panel 20 by means of tabs 41*a* and 41*b* that slide within the front slot 27*a* and the rear slot 27*b*, respectively, provided on the front and rear sides of the door latch area 27 of the door frame 25. The locking bar 40 is capable of continuously sliding up and down along the door latch area 27, and has upper and lower sets of holes 44*a* and 45*a* (on the front side of the front house panel 20) and corresponding upper end lower sets of holes 44*b* and 45*b* (on the rear side of the front house panel 20). The holes 44*a* and 45*a* are engageable by a spring-loaded depressible button 27*c* and the holes 44*b* and 45*b* are engageable by a spring-loaded depressible button 27*d* (buttons 27*c* and 27*d* may be integral with a spring 27*e*, such as a snap-button sold under the name VALCO). Both buttons 27*c* and 27*d* are mounted inside the door latch area 27 of the front house panel 20, with the button 27*c* extending from the front of the front house panel 20 and engaging the holes 44*a* and 45*a*, and the button 27*d* extending from the rear of the front house panel 20 and engaging the holes 44*b* and 45*b*.

Figure 5E:
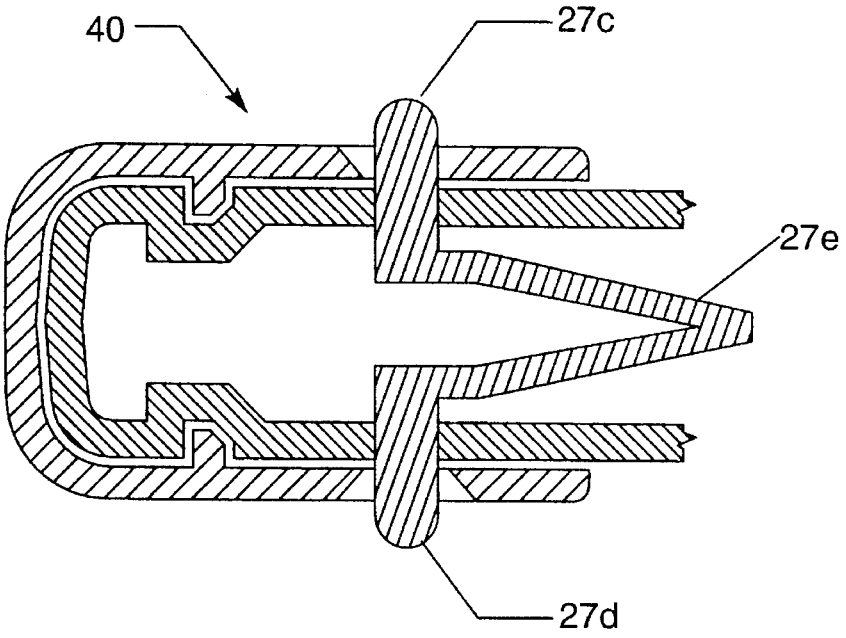
FIG. 5E is a cross-sectional partial view of the locking bar mounted on the door frame.
Figure 5A:
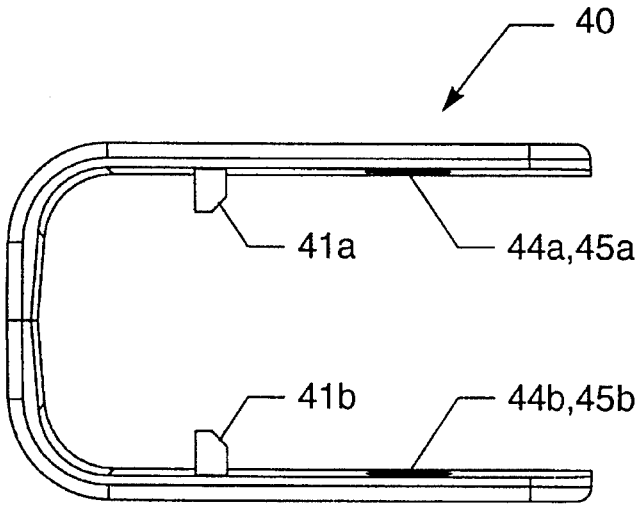
FIG. 5A, 5B, 5C and 5D are top, front, right side and rear views respectively, of the locking bar.
Figure 5B:
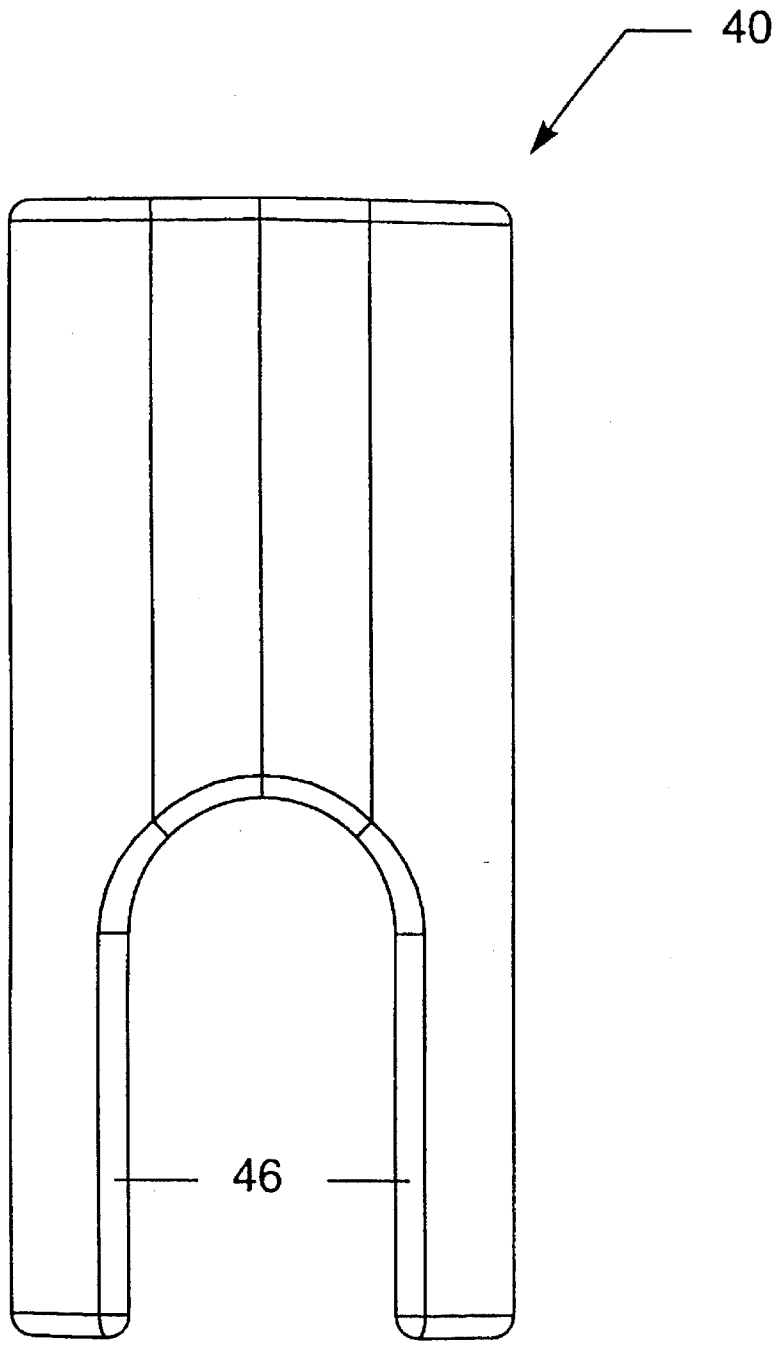
Figure 5C:
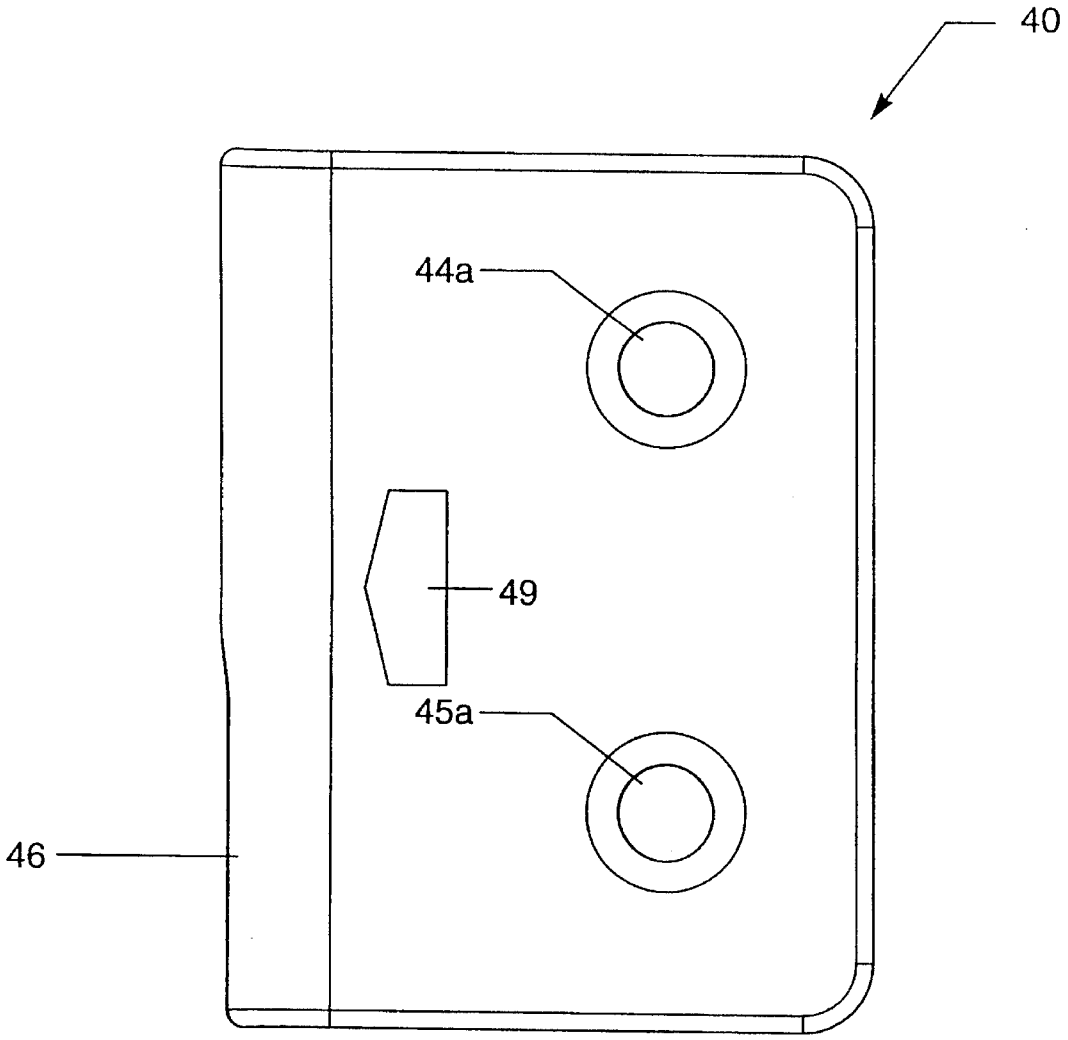
Figure 5D:
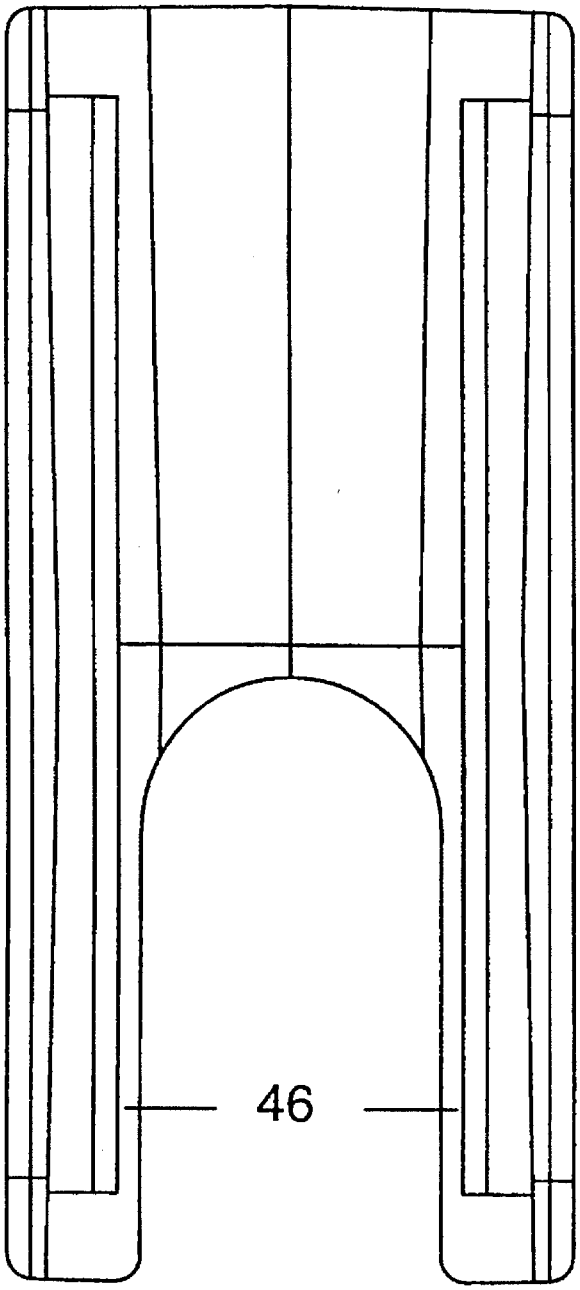

Each of the buttons 27*c* and 27*d* is independently depressible. FIG. 5E shows buttons 27*c* and 27*d* connected by a v-shaped spring 27*e*. In FIG. 6E, the buttons 27*c* and 27*d* are depicted as not depressed and being engaged in holes 44*a* and 44*b*. By depressing both buttons 27*c* and 27*d* simultaneously and sliding the locking bar 40, the locking bar may be selectively positioned in either an upper or a lower position. In the upper position, the buttons 27*c* and 27*d* engage holes 45*a* and 45*b*, respectively, and the locking bar 40 does not interfere with opening or closing the door. In the lower position, the buttons 27*c* and 27*d* engage holes 44*a* and 44*b*, respectively, and the cutout 46 of the locking bar engages with the rib 39 on the door 30 to securely hold the door 30 shut. Since the spring-loaded buttons 27*c* and 27*d* must be simultaneously depressed from both the rear, internal, side and the front, external, side of the front house panel 20, the locking bar 40 permits secure locking of the door 30 in a closed position for a child or infant who cannot reach over the front house panel 20 from within the enclosure so the infant or child will not be able to leave the enclosure.

A printed window aperture in the shape of an arrow 49 may be provided on one or both sides of the locking bar 40 and symbols 37, 38 such as one representing an unlocked state (symbol 37) and another representing a locked state (symbol 38) may be provided on the door 30 so that the arrow 49 points to the locked symbol 38, when the locking bar 40 is in the lower, locked closed position, and points to the unlocked symbol 37 when the locking bar 40 is in the upper, unlocked position, thus giving a visual indication of the locked/unlocked state of the door 30. An arrow symbol may be printed on the locking bar 40 in place of the window aperture 49. If a window aperture 49 is used, the color of the front house panel door latch area 27 is made contrasting to the color of the locking bar 40 so that the window provides a visible indicator.

The rear house panel 50 shown in FIGS. 7A through 7F is somewhat similar in construction to the front house panel 20 in that it includes an upper post 51, a lower post 52 and a middle post 53 similar to the top post 21, the lower post 22 and the middle post 23, on the front house panel 20. The locking caps 70, the sleeve 80, and the threaded knob 90 are also similar to those of the front house panel 20. Detents 8*a*, 58*b*, 59*a* and 59*b* are similar to the detents on the front house panel 20 and also help to position and hold the fence 60 panels when they are sandwiched between the fence panels in the compact storage mode. Various toys, decorations and activity items may be attached to the rear house panel, for example at locations 50*a*.

Four identical fence panels 60, illustrated in FIGS. 8A through 8G, are used in the present invention. Each fence panel 60 includes a top post 61, a lower post 62, and a middle post 63, which are generally similar to those on the front house panel 20 and the rear house panel 50. The locking caps 70, the sleeve 80, and the threaded knob 90 are also similar to those of the front house panel 20. The fence panels 60 may include vertical slots 65 which permit the child or infant in the enclosure to see out while remaining in the enclosure. These slots also facilitate the mounting of conventional crib toys to the fence panels 60 if desired. Of course, although four fence panels 60 are used in the preference embodiment, one skilled in the art would recognize that other numbers of fence panels and/or house panels might also be used.

Referring back to FIGS. 3D and 3E, it is to be noted that the upper post 21, the lower post 22, and the middle post 23, while extending out past the sides of the front house panel 20, also curve towards the rear of the front house panel 20. Similarly, referring back to FIGS. 7E and 7F, the upper post 51, the lower post 52, and the middle post 53 of the rear house panel 50, while extending out past the sides of the rear house panel 50, also curve towards the rear of the rear house panel 50. This permits the front house panel 20 to be interconnected directly with the rear house panel 50 in the compact storage mode, with both panels facing outwardly, as shown in FIGS. 1C, 2C, 2D and 2E. In this configuration, the fence panels 60 may be nested and trapped between the front and rear house panels 20 and 50 for storage in the compact storage mode.

Figure 10A:
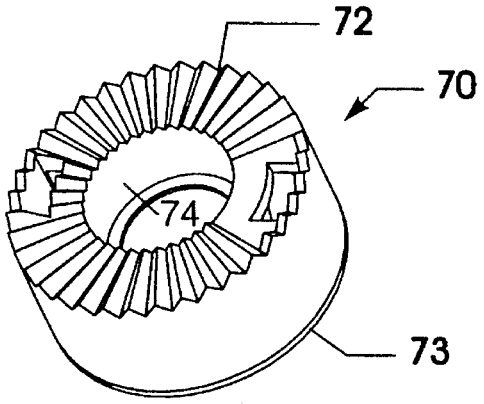
FIGS. 10A, 10B, and 10C are perspective, side and bottom views, respectively, of a locking cap.
Figure 10B:
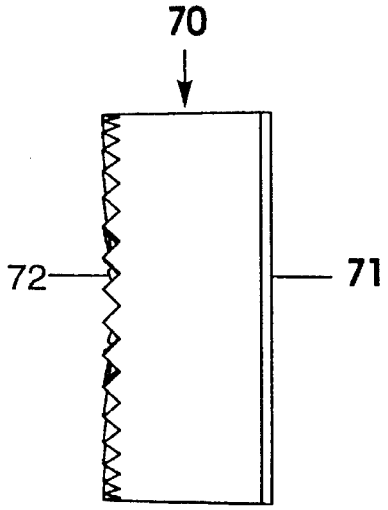
Figure 10C:
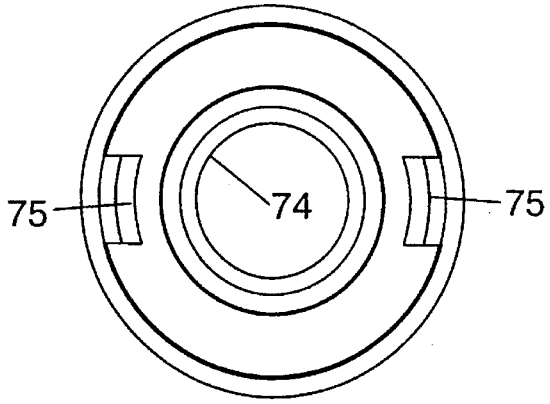

The connection system used for connecting the various panels 20, 50 and 60 will now be broadly described. In general, the connection of panels 20, 50 and 60 is provided by each panel having a top post 21, 51 or 61 extending from one side and a lower post 22, 52 or 62 extending from the same side and spaced below the top post. A locking cap 70, shown in FIGS. 10A through 10C, is mounted to the lower surface of each of the top posts 21, 51 and 61. A hole extends vertically through each of the lower posts 22, 52 and 62 to support a vertically oriented sleeve 80, shown in FIGS. 13A through 13G. The sleeves 80 each support a threaded knob 90, shown in FIGS. 14A through 14D. A middle post 23, 53 or 63 extends from the other side of each panel and a locking cap 70 is mounted on the upper surface of each of the middle posts 23, 53 and 63. A domed protrusion 23*a*, 53*a* or 63*a* on the lower surface of each of the middle posts 23, 53 and 63 is shaped to abut the upper end of the threaded knob 80.

The method of connecting any two panels will now be discussed in more detail, using the example of connecting two adjacent fence panels 60 to each other. The method of connection of a fence panel 60 to either the front house panel 20 or the rear house panel 50 is essentially the same. Also, the method of connection of the front house panel 20 and the rear house panel 50 to each other is essentially the same.

Figure 9A:
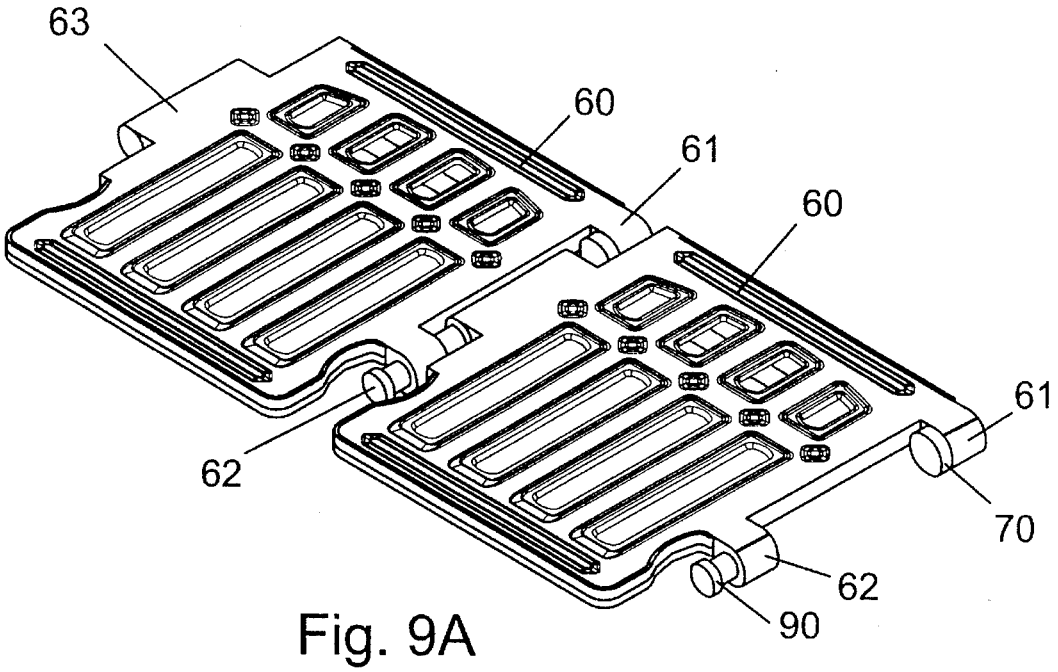
FIGS. 9A, 9B, and 9C are perspective views showing two fence panels connected to each other.
Figure 9B:
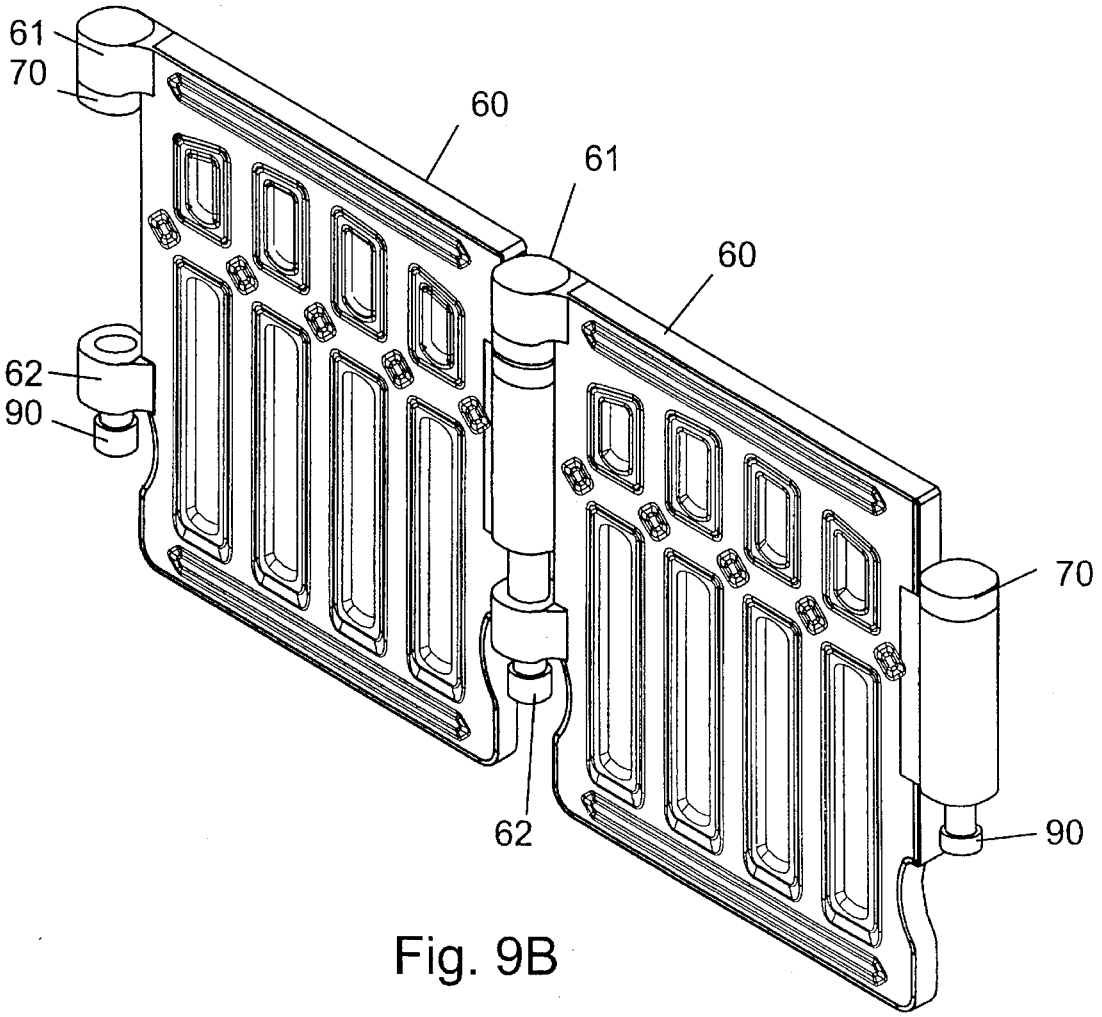
Figure 9C:
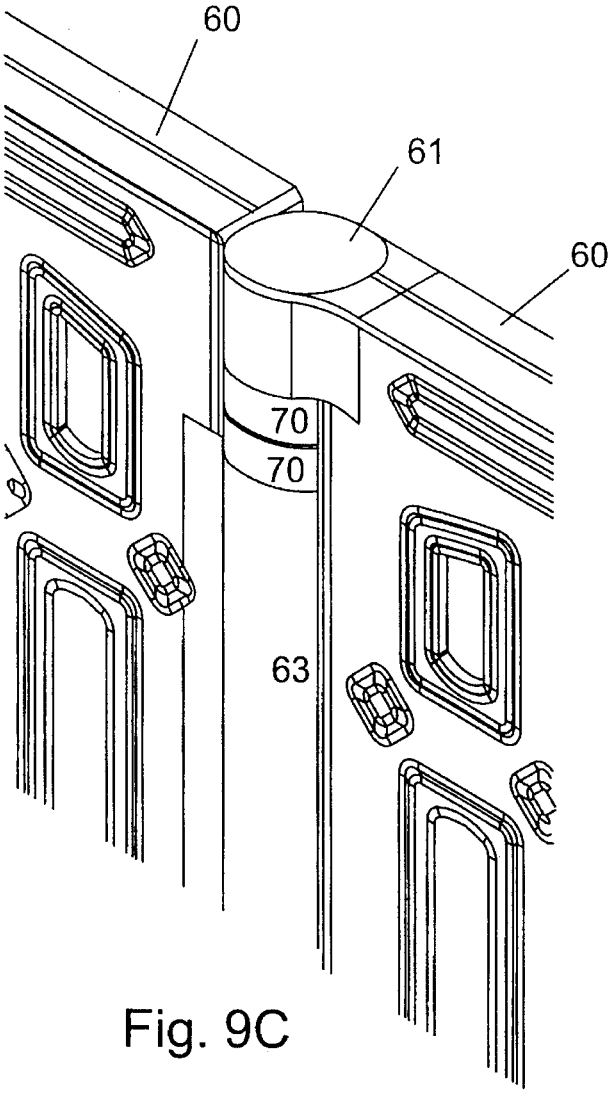
Figure 9D:
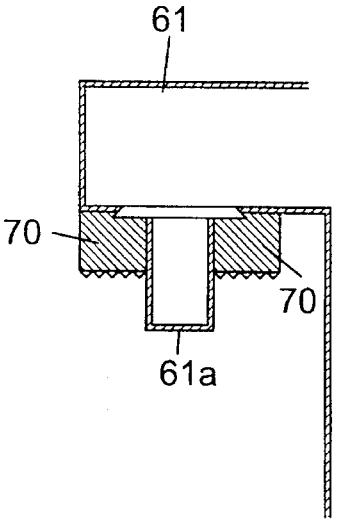
FIGS. 9D and 9E are cross-sectional partial views showing the locking caps mounted on a fence panel.
Figure 9E:
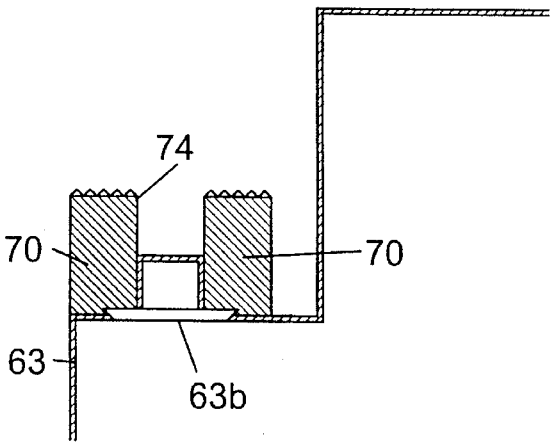

To connect two adjacent fence panels 60 as shown in FIGS. 9A and 9B, the panels are oriented so that the middle post 63 of one panel fits between the upper post 61 and the lower post 62 of the other panel and the panels are oriented at the desired angle with respect to each other. Each top post 61 has mounted on its lower end a locking cap 70 having a toothed side 72 pointing downwards, and each middle post 63 has mounted to its top surface another locking cap 70 having the toothed side 72 pointing upwards. Thus, as shown in FIG. 9C, when the middle post 63 of the first panel is placed just below the top post 61 of the second panel and urged upwardly, the toothed sides 72 of each locking cap 70 mesh with each other and hold the two panels 60 together.

The method of attachment of the locking caps 70 to the panels will now be described, using the example of a fence panel 60 and making reference to FIGS. 8B, 9D, 9E, 10A and 10C. The method of attachment of the locking caps 70 to the front house panel 20 and rear house panel 50 is the same.

The top post 61 has a cylindrical post 61*a* protruding as shown that fits into a cylindrical bore 74 of the locking cap 70. The length of the post 61*a* is greater than the height of the locking cap 70, so the end portion of the post 61*a* protrudes out beyond the toothed side 72 of the locking cap. The locking cap is held firmly over the post 61*a* by being snapped on in any suitable fashion, for example by tabs (not shown) adjacent the post 61*a* that engage a rim 75 in the locking cap 70.

The middle post 63 has a cylindrical post 63*a* protruding as shown that fits into a cylindrical bore 74 of another locking cap 70. The length of the post 63*b* is less than the height of the locking cap 70, so the end portion of the post 61*a* remains inset in the bore 74. The locking cap 70 is held firmly over the post 63*b* by being snapped on in any suitable fashion, for example by tabs (not shown) adjacent the post 63*b* that engage a rim 75 in the locking cap 70.

When the caps 70 are urged together, the protruding portion of the post 61*a* (protruding beyond the locking cap 70) is able to fit inside the top of the bore 74 of an opposing locking cap 70 (mounted over the post 63*b*) to assist in aligning the locking caps when connecting two panels. The insertion of the post 61*a* into the bore 74 of the opposing locking cap also enhances the structural interconnection at the connection of the opposing locking caps 70.

The front and rear house Panel 20, 50 each have a post (similar to post 61*a*) protruding down from upper post 21, 31 onto which one locking cap 70 is mounted and also have a post (similar to post 63*b*) protruding up from middle post 23, 33 onto which another locking cap 70 is mounted, all locking caps 70 are mounted in a similar fashion.

Figure 11:
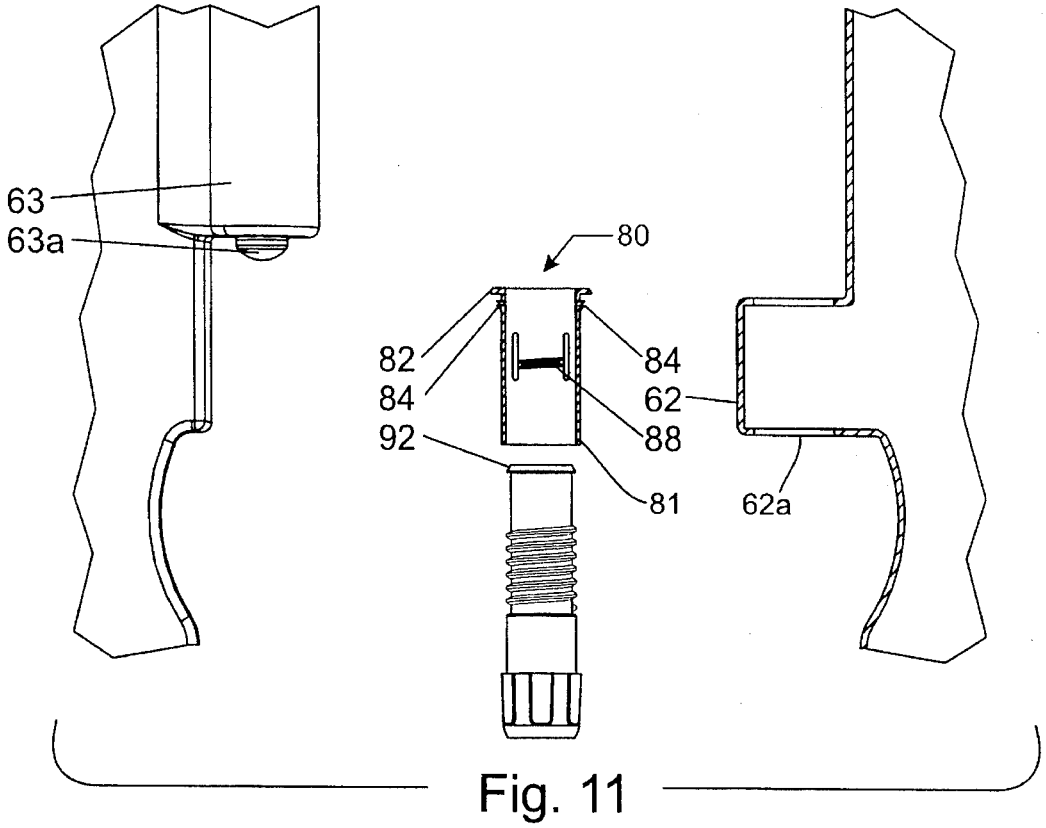
FIG. 11 is an exploded, partially cross-sectional view showing the sleeve and threaded knob.
Figure 12A:
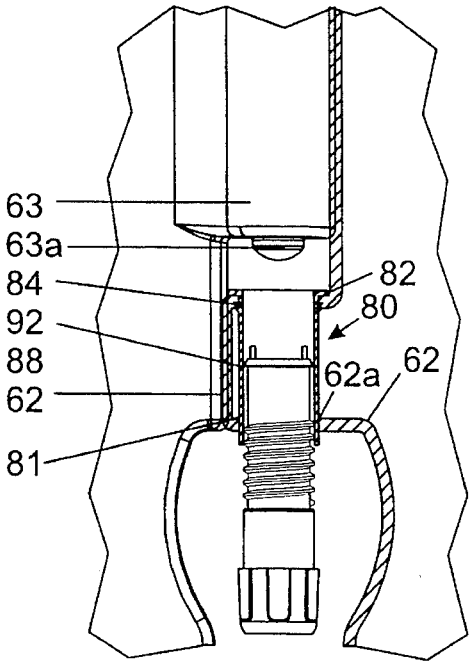
FIG. 12A and 12B are partially cross-sectional layout views showing the assembled sleeve and threaded knob.
Figure 12B:
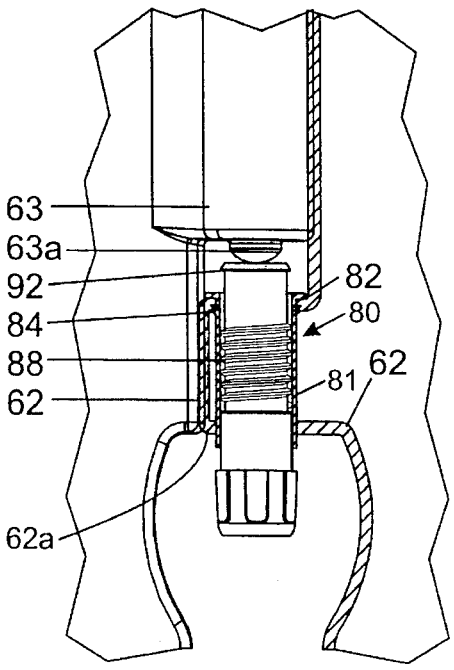
Figure 13B:
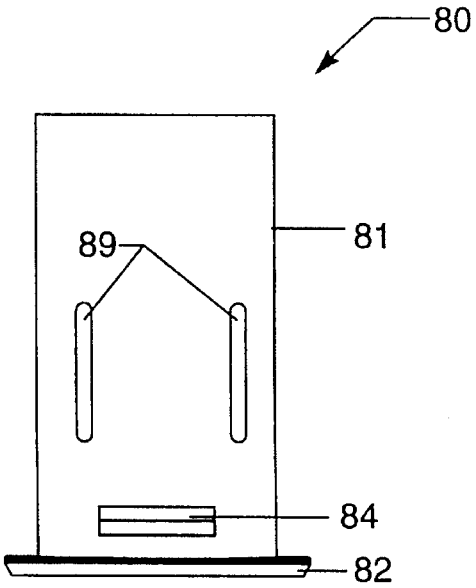
FIGS. 13A, 13B, 13C, 13D and 13G are perspective, front, rear, right side and bottom views, respectively, of the sleeve.
Figure 13G:
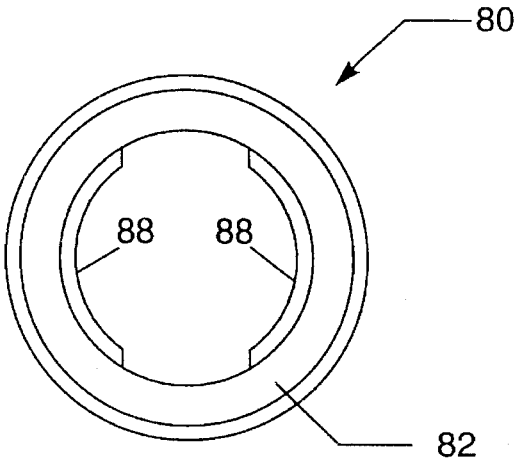
Figure 13A:
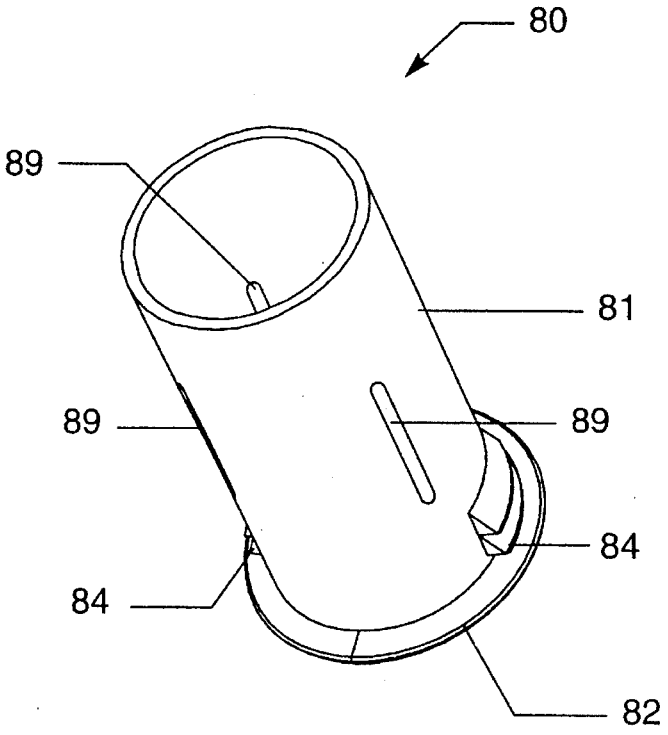
Figure 13E:
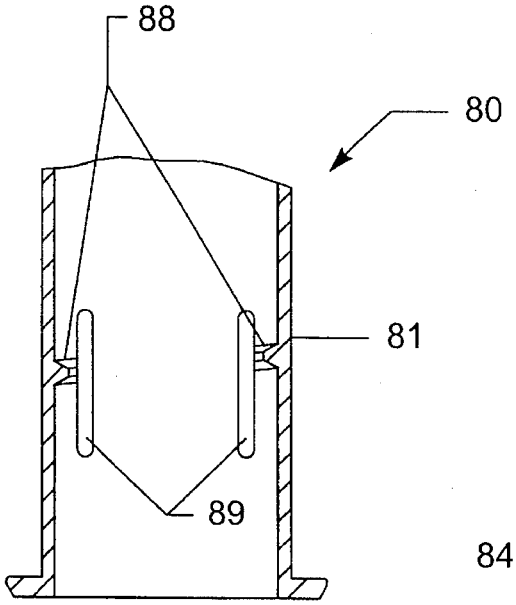
FIG. 13E is a cross-sectional view taken along line 13E in FIG. 13D.
Figure 13D:
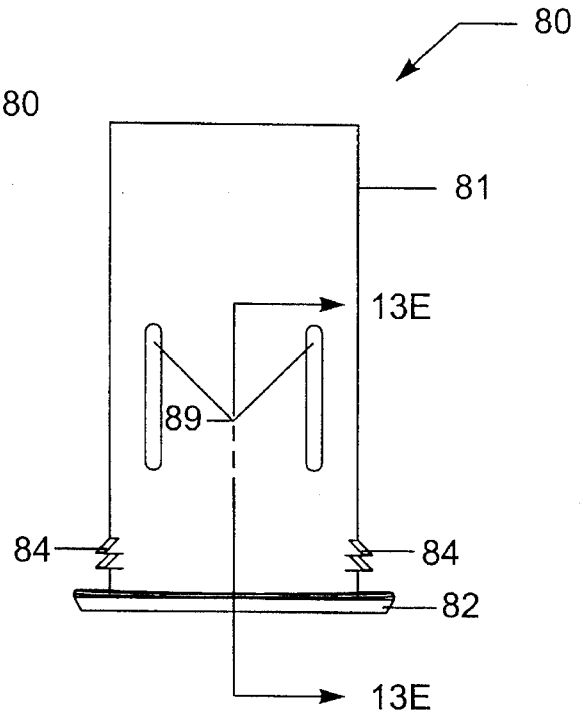
Figure 13C:
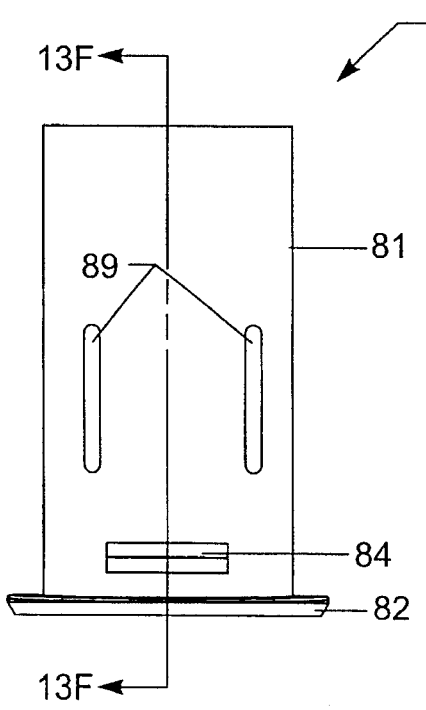
Figure 13F:
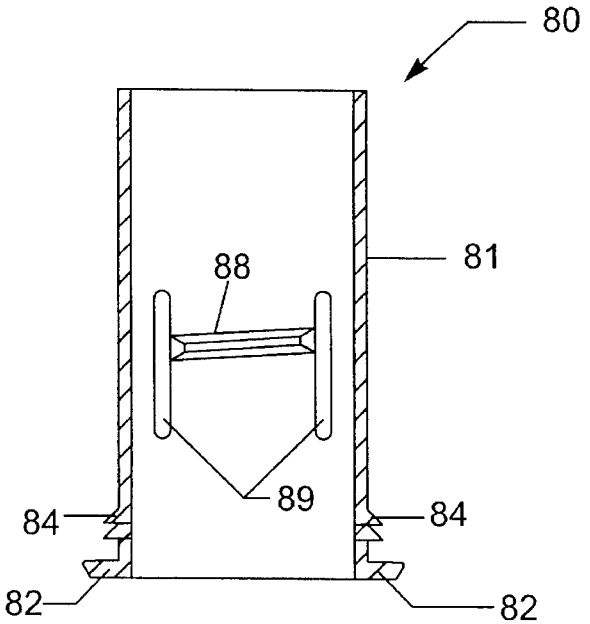
FIG. 13F is cross-sectional view taken along line 13F in FIG. 13C.

Referring now to FIGS. 11, 12A, and 12B, each lower post 62 has a hole 62*a* drilled therethrough with a sleeve 80 snap-fit inside the hole 62*a*. The sleeve 80 consists of a cylindrical body 81 having a top flange surface 82. Once inserted, the sleeve 80 is also retained in position in the hole 62*a* by resilient tabs 84 that engage the inside of the hollow panel. The sleeve 80 has an internal threaded portion 88 which may comprise only part of one thread rotation as shown.

The sleeve 80 supports a threaded knob 90, which comprises a cylindrical body 91 having an flange 92, a threaded portion 93, and a lower handle portion 94. During manufacturing, the threaded knob 90 is able to be inserted into sleeve 80 because of vertical cutouts 89 provided in the sleeve 80 which allow the sleeve 80 to expand radially to permit the flange 92 of the threaded knob 90 to pass over the internal thread 88 of the sleeve 80.

When assembled within the sleeve 80, the threaded knob 90 is trapped within the sleeve 80 by contact of the flange 92 with the internal thread 88 so that even when the knob 90 is in its lower-most position shown at FIG. 12A (at which the threaded portion 93 is not in mating contact with the internal thread 88) the knob 90 cannot fall out of the sleeve 80.

To connect two panels together, the threaded knob 90 is urged upwardly and rotated by manipulating and rotating the handle portion 94 so that the threaded portion 93 engages the internal thread 88, and the threaded knob 90 is thus urged upward relative to the sleeve 80 by the threads. As depicted in FIG. 12B, when this operation is performed, the flange 92 at the top end of the threaded knob 90 is urged upwardly so that it extends upward past the top surface of the lower post 62 until the threaded knob 90 is raised far enough so that it eventually contacts the lower domed surface 63*a* of the middle post 63.

The lower domed surface 63*a* of the middle post 63 is adapted to self-center within the top flange 92 of the threaded knob 90, and when the threaded knob is fully tightened, the flange 92 presses firmly against the domed surface 63*a* and pushes the middle post 63 on one panel upward toward the upper post 61 on the other panel. This forces the two locking caps 70 into a tight contact so that the two panels are tightly secured together.

In this way, the panels are held together at two locations as shown in FIGS. 9A and 9B. First the two locking caps 70 are forced into contact with each other with their toothed sides 72 in mating contact, providing a secure contact between the upper end of the middle post 63 and the lower end of the top post 61. Second, the flange 92 at the top end of the threaded knob 90 is in firm contact with the domed surface 63*a*, providing a secure contact between the lower end of the middle post 63 and the upper end of the lower post 62.

In the preferred embodiment the apparatus has a total of six panels—the front and rear house panels 20 and 50 and the four fence panels 60. However, it will be appreciated that the total number of panels might be varied in alternative embodiments. For example, in alternative embodiments only three or four total panels (including any combination of house and fence panels) might be used. Alternatively, the number of total panels might be five, seven or a greater number. Also, although the panels in the preferred embodiment are generally of a substantially flat shape, other panels having different shapes and sizes are applicable in the invention.

Further, in the preferred embodiment both the front and rear house panels 20 and 50, the door 30, and the fence panels 60 are hollow and blow molded from plastic. The locking bar 40, locking caps 70 the sleeve 80 and the threaded knob 90 are injection molded. However, other suitable materials and/or any other suitable molding or other manufacturing methods may be used to manufacture any or all of the components. Also, in the preferred embodiment the panels 20, 30, 50 and 60 are generally of a hollow construction; however, they may of course be molded or formed as solid parts from any suitable material, including but not limited to plastic, wood or metal.

What is claimed is:

1. An enclosure apparatus comprising:

a plurality of panels, each said panel having a first side and a second side;

a plurality of first connector portions, each of said first connector portions being mounted on one of said first sides of one of said panels, respectively;

a plurality of second connector portions, each of said second connector portions being mounted on one of said second sides of one of said panels, respectively, and any of said second connector portions being releasably connectable with any of said first connector portions to connect any one said panel to any other said panels at more than one relative angle, so that one said panel is detachably connectable to another said panel with any one of the more than one angles therebetween; and a mechanism for selectively locking one of said first connector portions to one of said second connector portions to selectively fix the relative angle between two connected ones of said panels.

2. An enclosure apparatus according to claim 1, further comprising a door panel, and wherein one of said panels defines a doorway opening and said door panel is hingedly mounted at said doorway opening.

3. An enclosure apparatus, comprising:

a first panel having a first connector and a second connector mounted thereto, and said first panel having a first back surface located between said first and second connectors;

a second panel having a third connector and a fourth connector mounted thereto, and said second panel having a second back surface located between said third and fourth connectors; and a third panel having a fifth connector and a sixth connector mounted thereto, wherein said first, third and fifth connectors are each attachable to one of said second, fourth, and sixth connectors, respectively, to connect said first, second and third panels in a first configuration to form an enclosure, and wherein said first and third connectors are attachable to said fourth and second connectors, respectively, to connect said first and second panels in a second configuration with said third panel trapped between said first and second panels by contact with said first and second back surfaces.

4. An apparatus according to claim 3, wherein one of said first and second back surfaces comprises a first indentation shaped to conform to said third panel, and wherein said third panel is nestable in said first indentation, said third panel being trapped between said first and second panels in the second configuration.

5. An enclosure apparatus, comprising:

a first panel having a first connector and a second connector mounted thereto, and said first panel having a first back surface located between said first and second connectors;

a second panel having a third connector and a fourth connector mounted thereto, and said second panel having a second back surface located between said third and fourth connectors;

a third panel having two sides and a fifth connector and a sixth connector mounted thereto; and a fourth panel having a seventh connector and an eighth connector mounted thereto, wherein said first, third, fifth and seventh connectors are each independently releasably attachable to one of said second, fourth, sixth, and eighth connectors, respectively, to releasably connect said first, second, third and fourth panels in a first configuration to form an enclosure, and wherein said first and third connectors are each independently releasably attachable to said fourth and second connectors, respectively, to connect said first and second panels in a second configuration with said third and fourth panels trapped between said first and second panels by contact with said first and second back surfaces.

6. An apparatus according to claim 5, wherein said first back surface comprises a first indentation shaped to conform to one of said third and fourth panels and said second surface comprises a second indentation shaped to conform to one of said third and fourth panels, and wherein said third and fourth panels are each nestable in one of said first and second indentations, said third and fourth panels being trapped between said first and second panels in the second configuration.

7. An enclosure apparatus, comprising:

a first panel having a first connector and a second connector mounted thereto, and said first panel having a first back surface located between said first and second connectors;

a second panel having two sides and a third connector and a fourth connector mounted thereto, and said second panel having a second back surface located between said third and fourth connectors;

a third panel having a fifth connector and a sixth connector mounted thereto;

a fourth panel having a seventh connector and an eighth connector mounted thereto;

a fifth panel having a ninth connector and a tenth connector mounted thereto; and a sixth panel having an eleventh connector and a twelfth connector mounted thereto, wherein said first, third, fifth, seventh, ninth and eleventh connectors are each independently releasably attachable to one of said second, fourth, sixth, eighth, tenth and twelfth connectors, respectively, to releasably connect said first, second, third, fourth, fifth and sixth panels in a first configuration to form an enclosure, and wherein said first and third connectors are each independently releasably attachable to said third and second connectors, respectively, to connect said first and second panels in a second configuration with said third, fourth, fifth and sixth panels trapped between said first and second panels by contact with said first and second back surfaces.

8. An apparatus according to claim 7, wherein said first back surface comprises a first indentation shaped to conform to one of said third, fourth, fifth and sixth panels and said second surface comprises a second indentation shaped to conform to one of said third, fourth and sixth panels, and wherein said third, fourth, fifth and sixth panels are each nestable in one of said first and second indentations, said third, fourth, fifth and sixth panels being trapped between said first and second panels in the second configuration.

9. A connector system for detachably connecting a first panel to a second panel, comprising:

a first connector portion on the first panel having a first contact portion;

a second connector portion on the first panel spaced apart from said first connector portion by a space defined between said first and said second connector portions and said second connector portion having a second contact portion;

a third connector portion on the second panel, shaped to fit between said first and second connector portions, and said third connector having a third contact portion for contacting said first contact portion and a fourth contact portion for contacting said second contact portion; and a releasable mechanism for selectively urging said first contact portion into contact with said third contact portion and said second contact portion into contact with said fourth contact portion, respectively, to hold said third connector portion securely between said first and second connector portions, thereby connecting the first panel to the second panel, wherein when said mechanism is released, said panels are detachable.

10. A connector system according to claim 9, wherein said first contact portion comprises a first toothed surface and said second contact portion comprises a second toothed surface, and wherein said first toothed surface mates with said second toothed surface when said first and second contact portions are urged together.

11. A connector system according to claim 10, wherein said releasable mechanism comprises a cylindrical body having a threaded portion, a handle end, and a contact end, and said second connector portion defines an aperture extending through said second connector portion having an internal thread, said cylindrical body being mounted in said aperture and said threaded portion engageable with said internal thread, and said second contact portion being located at said contact end, so that rotation of said cylindrical body causes said second contact portion to engage said fourth contact portion.

12. A lock mechanism for selectively locking closed a door hingedly mounted in a doorway opening defined by a door frame, comprising:

a bar having two ends and a substantially u-shaped profile slidably mounted for travel between a first position and a second position on the door frame at the doorway opening, said bar having a cutout defined at one end;

a rib located on the door, said rib being engaged by said cutout when said bar is in the first position to hold the door closed, and said rib not being engaged by said cutout when said bar is in the second position; and a selectively releasable engaging member mounted to the panel for releasably engaging said bar to hold said bar in one of the first and second positions.

13. A lock mechanism according to claim 12, wherein said bar has a first aperture and a second aperture defined therethrough and wherein said releasable engaging member comprises a spring-biased button mounted to the panel and protruding from the panel to selectively engage one of said first and second apertures.

14. A lock mechanism according to claim 12, further comprising an indicator for indicating one of a locked and an unlocked state of said lock mechanism.

* * * * *